US010864547B2

(12) United States Patent
Michals et al.

(10) Patent No.: US 10,864,547 B2
(45) Date of Patent: Dec. 15, 2020

(54) TOUCH UP PAINT KIT

(71) Applicants: Richard Michals, Melville, NY (US); Roger Kleinman, Northport, NY (US)

(72) Inventors: Richard Michals, Melville, NY (US); Roger Kleinman, Northport, NY (US)

( * ) Notice: Subject to any disclaimer, the term of this patent is extended or adjusted under 35 U.S.C. 154(b) by 0 days.

(21) Appl. No.: 15/888,007

(22) Filed: Feb. 3, 2018

(65) Prior Publication Data

US 2019/0240695 A1 Aug. 8, 2019

(51) Int. Cl.

| | |
|---|---|
| ***B05C 17/03*** | (2006.01) |
| ***B05C 17/02*** | (2006.01) |
| ***B05C 11/10*** | (2006.01) |
| ***B05C 1/08*** | (2006.01) |
| ***B05C 17/10*** | (2006.01) |

(52) U.S. Cl.

CPC ..... *B05C 17/03* (2013.01); *B05C 1/0813* (2013.01); *B05C 11/1047* (2013.01); *B05C 17/0245* (2013.01); *B05C 17/10* (2013.01)

(58) Field of Classification Search

CPC ... B05C 17/03; B05C 1/0813; B05C 17/0245; B05C 11/1047; B05C 17/10; B44D 3/128; B44D 2/002; B44D 3/00; B44D 3/12; B65D 51/32; B65D 35/22; B65D 35/26

USPC ..... 118/258

See application file for complete search history.

(56) References Cited

U.S. PATENT DOCUMENTS

| | | | | |
|---|---|---|---|---|
| 3,938,686 A * | 2/1976 | Milligan | B44D 3/12 215/232 |
| 5,533,802 A * | 7/1996 | Garganese | B01F 11/0082 366/256 |
| 6,446,827 B1 * | 9/2002 | Akins | B44D 3/12 220/570 |
| 6,776,548 B2 * | 8/2004 | Gardner, Jr. | A45C 5/02 401/16 |

(Continued)

FOREIGN PATENT DOCUMENTS

CA 2922414 * 3/2015

*Primary Examiner* — Laura Edwards

(74) *Attorney, Agent, or Firm* — Michael L. Greenberg, Esq.; Greenberg & Lieberman, LLC

(57) ABSTRACT

One embodiment of a container for transferring, storing, and dispensing paint indefinitely for touch-up painting by the use of a plurality of open-ably close-able apertures (310, 320) that cause transferring, storing, and dispensing of paint, in conjunction with a plurality of paint storage areas (1391, 153) that are independently open-ably sealable to allow for various functions such as, sealed storing of paint in one paint storage area while doing touch-up painting from another paint storage area, moving paint from external paint source to a paint storage area, moving paint between paint storage areas. Using standard (180, 190), as well as custom paint applicators allowing for ease of use, and with various features that allow for use with no clean up needed, such as replaceable components (121, 130, 170, 180, 190, 191, 192, 250) non-stick components (121, 130, 141), integral paint tray (130), paint containment features such as paint retaining walls (130) and paint catching recesses (130, 140). Carrying Tray (210) prevents spilling and holds replaceable parts (121, 130, 170, 180, 190, 191, 192, 250) for storage and transport. Other embodiments are described and shown.

3 Claims, 33 Drawing Sheets

(56) References Cited

U.S. PATENT DOCUMENTS

| | | | | |
|---|---|---|---|---|
| 7,182,538 | B2 * | 2/2007 | Grosso | A46B 11/0055 401/171 |
| 9,381,769 | B2 * | 7/2016 | Flynn | B67D 7/06 |
| 2010/0243656 | A1 * | 9/2010 | Nazarian | B67D 7/02 220/495.02 |
| 2012/0034014 | A1 * | 2/2012 | Cassidy | A46B 11/0013 401/129 |
| 2013/0068639 | A1 * | 3/2013 | Plouffe | B44D 3/126 206/223 |
| 2013/0171362 | A1 * | 7/2013 | Wiener | B05C 17/003 427/429 |

* cited by examiner

TOUCH UP PAINT KIT

BACKGROUND–PRIOR ART

The following is a tabulation of some prior art that presently appears relevant:

| U.S. Patents | | | |
|---|---|---|---|
| Pat. No. | Kind Code | Issue Date | Patentee |
| 3,938,686 | A | 1976 Feb. 17 | Milligan et al. |
| 6,446,827 | B1 | 2002 Sep. 10 | Akins |
| 6,776,548 | B2 | 2004 Aug. 17 | Gardner, Jr. et al. |
| 7,182,538 | B2 | 2007 Feb. 27 | Grosso et al. |
| 9,381,769 | B2 | 2016 Jul. 5 | Flynn |
| 20120034014 | A1 | 2012 Feb. 9 | Cassidy |
| 20130171362 | A1 | 2013 Jul. 4 | Wiener |

| Foreign Patent Documents | | | | |
|---|---|---|---|---|
| Foreign Doc. Nr. | Cntry Code | Kind Code | Pub. Dt. | App or Patentee |
| 2015027338 | CA | A1 | 2015 Mar. 5 | Kapitor-Robertson |

Anyone who has painted a home, room, apartment, ceiling, or other surfaces, including but not limited to home owners and business owners, often need to do touch-up painting to smaller sections of said walls, ceilings, surfaces that were painted and have later been scuffed, marred, scraped, or damaged over shorter and longer periods of time. Many types of touch-up paint kits have been created which try to address the need to do this touch-up painting.

Optimally touch-up paint kits should be easy to use, allowing the user to have access to paint applicators and accessories used with typical larger painting projects, they should minimize clean up, allow for varying amounts of paint touch-up, from a thin, small scratch to a lengthy, broad scrape as would occur when a large piece of furniture scrapes paint off a wall during furniture moving. Touch-up paint kits should also allow ease of use when doing overhead touch-up painting and when touch-up painting hard to reach places like between refrigerators and wall mounted cabinets, and they should be re-useable, whenever needed, indefinitely. Although there are known touch-up paint kits, nevertheless all suffer from some disadvantages.

(a) Some touch-up paint kits use a small Syringe type of applicator that cannot be used effectively on larger scrapes, these are cumbersome to do touch-up painting with as they require more dexterity to use, they need to have pistons pressed, or knobs turned, or containers squeezed, moving paint onto paint applicator while simultaneously having to apply paint which also makes overhead painting and the painting of hard to reach places difficult. Gardner, Jr. et al., Grosso et al., and Wiener are examples of these types of applicators.

(b) Some touch-up paint kits require the use of a separate Syringe to fill the applicator. Wiener is an example of this type of applicator.

(c) Some touch-up paint kits use a larger applicator attached to a larger handle apparatus that holds stored paint and cannot touch-up paint smaller scratches effectively. These larger applicators are cumbersome to hold during touch-up painting due to the excessive weight of stored paint in the applicator, again making overhead painting and painting in hard to reach places difficult. Flynn, and Cassidy are examples of these types of applicators.

(d) Some touch-up paint kits do not allow for air to escape when filling paint storage areas as they have no secondary aperture to vent out trapped air, this can cause a mess during paint transfer which will require the use of drop cloths, or newspapers and post touch-up clean up. Flynn, is an example of this type of touch-up paint kit.

(e) Some touch-up paint kits do not allow for air to enter and replace the vacuum created when paint is distributed out onto applicator when applicator with internal paint storage area is compressed, pushed, rotated, to push out paint onto/into applicator tip, this can cause paint dripping and additional post touch-up clean up. Flynn, and Cassidy are examples of these types of applicators.

(f) Some touch-up paint kits have no paint roller. A paint roller is a highly effective applicator for quickly touch-up painting a larger scraped, blemished, marred surface. Milligan et al., Akins, Gardner, Jr. et al., Grosso et al., Flynn, Cassidy, and Wiener are examples of these types of touch-up paint kits with no Paint Roller.

(g) To properly use a paint roller, you must have a paint tray with a surface available to roll the paint roller on, to remove excess paint from paint roller prior to doing touch up painting. Without this paint tray the use of a paint roller will require purchasing a separate paint roller, and drop cloths, or newspapers, and will be messy requiring post touch-up clean up. Milligan et al., Akins, Gardner, Jr. et al., Grosso et al., Flynn, Cassidy, Wiener, and Kapitor-Robertson are examples of these types of touch-up paint kits with no Paint Tray that would have allowed for the removal of excess paint from paint roller.

(h) Some touch-up paint kits require the use of a funnel for paint transfer to paint storage area, this is messy and requires post touch-up clean up. Flynn, Cassidy, and Kapitor-Robertson are examples of these types of touch-up paint kits.

(i) Some touch-up paint kits are messy as the applicator and part of the applicator handle can be immersed in wet paint during storage. When the applicator is retrieved from paint storage area for use it will be dripping wet paint and require drop cloths or newspapers, and post touch-up clean up. Gardner, Jr. et al, and Kapitor-Robertson are examples of this type of touch-up paint kit.

(j) Some touch-up paint kits do not properly re-seal and paint clogs up the aperture that paint needs to travel through to be applied due to paint drying between uses and/or after multiple uses. Milligan et al., Gardner, Jr. et al. are examples of this type of touch-up paint kit.

(k) Some touch-up paint kits require being inverted repeatedly during use to get paint onto applicator tip, this is a tedious and strenuous effort that must be applied on the part of the user and with every inversion there is a possibility of dripping paint, so drop cloths, or newspaper, or some other protective covering should be laid down prior to use and will require additional post touch-up clean up. Although some have an angle on the applicator section relative to the longitudinal axis of paint storage area, they still require this inverting of the applicator to get paint from paint storage area of applicator to the applicator tip, especially when doing overhead touch-up painting and more inversion of applicator will be needed when volume of wet paint in paint storage area gets lower as paint is applied. Flynn, and Cassidy are examples of this type of touch-up paint kit.

(l) Some touch-up paint kits require a precise maximum amount of paint to be placed into paint storage area or there will be spillage with subsequent usage. Akins, and Kapitor-Robertson are examples of these types of touch-up paint kits.

(m) Some touch-up paint kits can be easily knocked over during use, so drop cloths or newspaper or some other protective covering should be laid down prior to use and will require additional post touch-up clean up. Flynn, Cassidy, and Kapitor-Robertson are examples of these types of touch-up paint kits.

(n) Some touch-up paint kits will leak due to gravity as they depend on gravity to move paint from paint storage area to applicator tip when inverted for said purpose, so drop cloths or newspaper or some other protective covering should be laid down prior to use and will require additional post touch-up clean up. Flynn, and Cassidy are examples of these types of touch-up paint kits.

(o) Some touch-up paint kits will drip paint if paint is not applied to a surface immediately after a piston has been pushed or a knob has been turned to move paint from paint storage area to applicator tip, so drop cloths, or newspaper would need to be put down prior to use and will require additional post touch-up clean up. Gardner, Jr. et al., Grosso et al., Flynn, Cassidy, and Wiener, are examples of these types of touch-up paint kits.

(p) Some touch-up paint kits allow for a large amount of air to be stored in the paint storage area, the humidity of said stored air can often be low, where this exposure of stored paint to said low humidity air causes for surface of paint to start to dry, limiting the storage life of the paint. Milligan et al., Akins, Gardner, Jr. et al., Grosso et al., Flynn, Cassidy, Wiener, and Kapitor-Robertson, are examples of these types of touch-up paint kits.

SUMMARY

In accordance with one embodiment a Touch-Up Paint Kit that comprises an integral replaceable paint tray to allow for the effective use of a replaceable paint roller without the need for putting down drop cloths or having to do any post paint touch-up cleaning.

Advantages

The use of the disclosed Touch-Up Paint Kit allows for easy paint touch-ups where there is no need to pour paint from one container to another, or no need to lay out drop cloths, or no need to reseal paint cans which have dried paint in the groove at the top of the paint can where the paint can cap can no longer fit into because of said dry paint which got into said groove if paint had needed to be poured. No need for any tools like screw drivers for opening paint cans, or hammers for closing paint cans. No need for a separate syringe as the retrieval and distribution of paint is integral to Touch-Up Paint Kit. Paint can be used in small increments that match a user's specific needs. The apparatus can be used indefinitely as all components that get paint on them are non-stick, and or disposable, and or washable, and or replaceable. Other advantages of one or more aspects will be apparent from a consideration of the drawings and ensuing description.

DRAWINGS—FIGURES

Figures 37A, 37B, 37C:
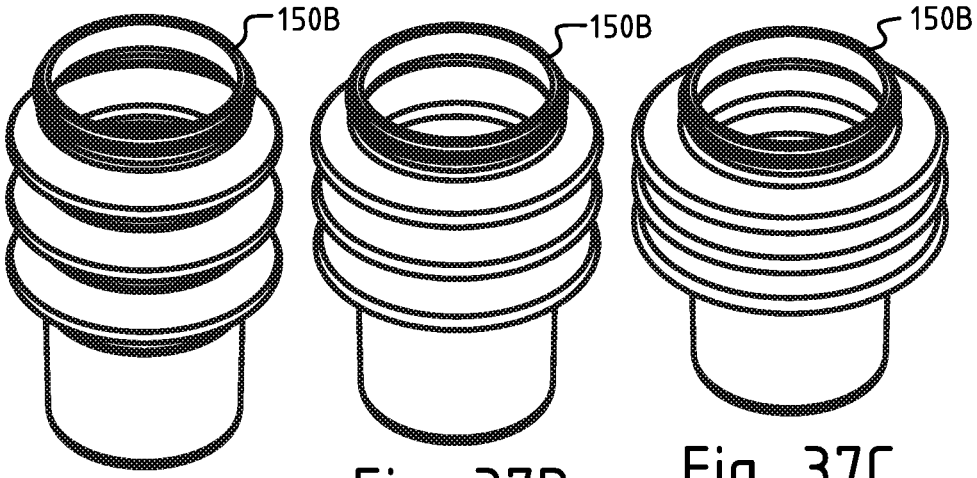

FIG. 37A, FIG. 37B, and FIG. 37C show perspective views of multiple possible interior volumes of an additional embodiment of Cup.

Figures 38A, 38B, 38C:
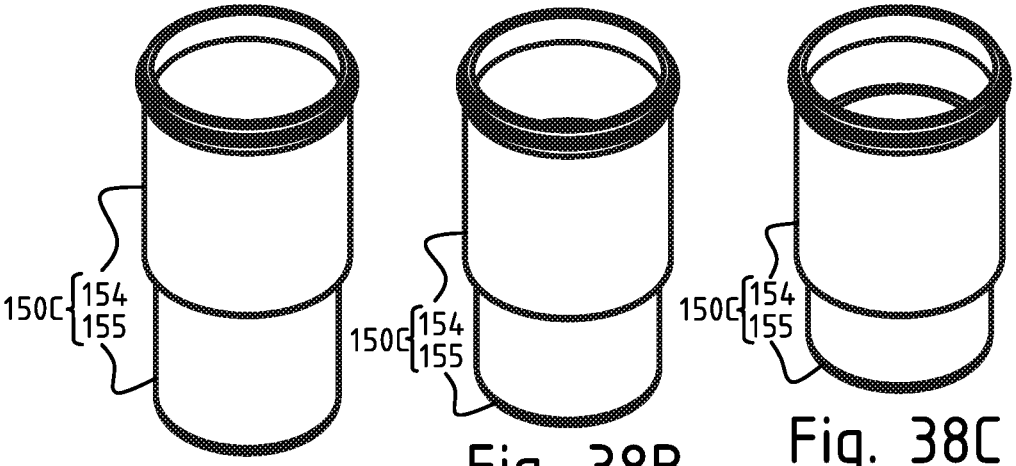

FIG. 38A, FIG. 38B, and FIG. 38C show perspective views of multiple possible interior volumes of another additional embodiment of Cup.

Figures 39A, 39B, 39C:
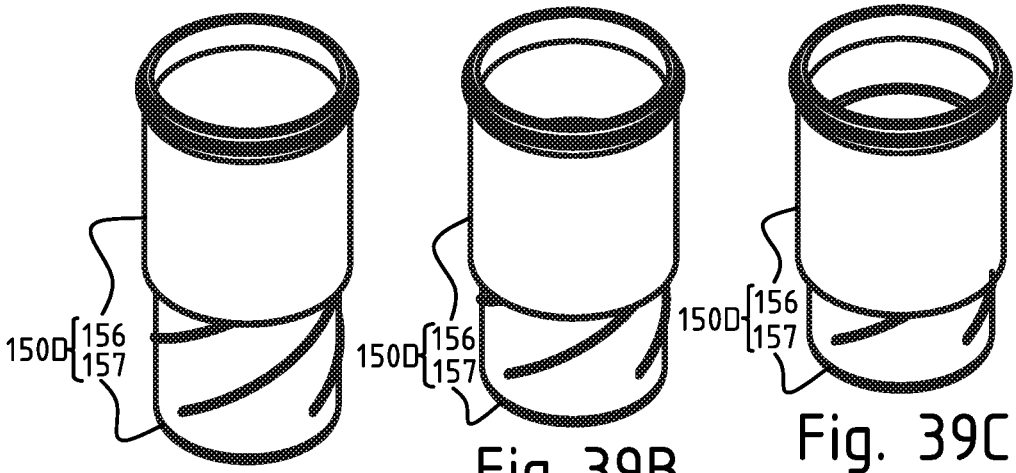

FIG. 39A, FIG. 39B, and FIG. 39C show perspective views of multiple possible interior volumes of another additional embodiment of Cup.

Figure 40:
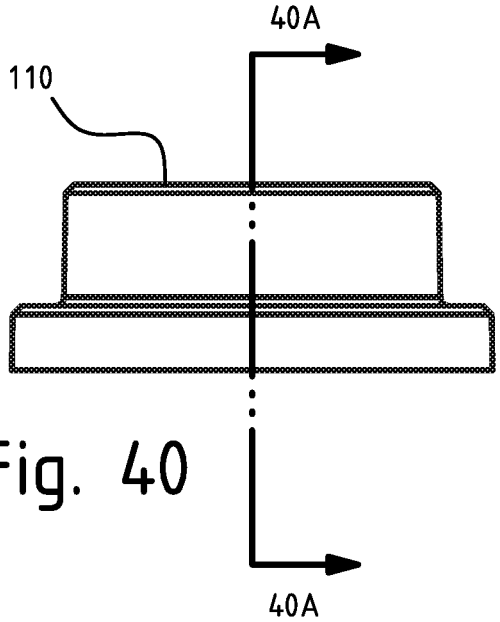

FIG. 40 shows a plan view of Top Cap.

Figure 40A:
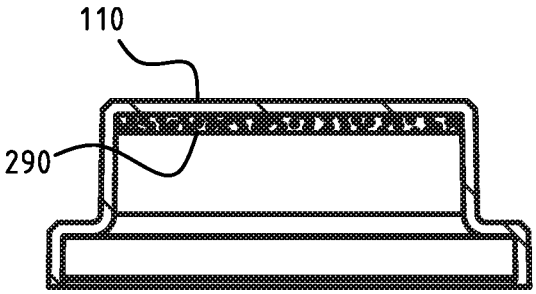

FIG. 40A is a cross section of FIG. 40 showing an alternative embodiment of Top Cap with a moisture distributor installed.

Figure 41:
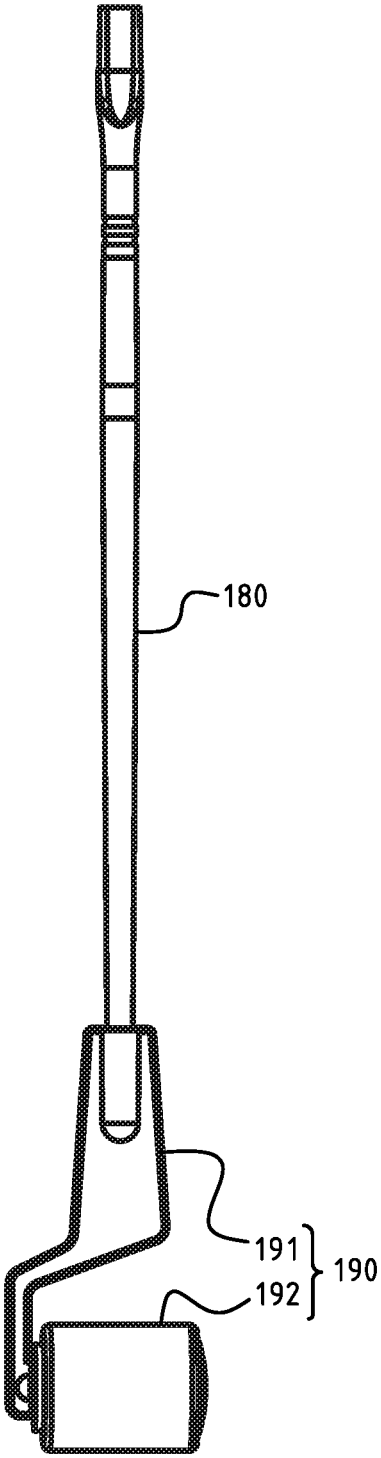

FIG. 41 is a plan view of a disposable paint brush connected to paint roller.

Figure 42:
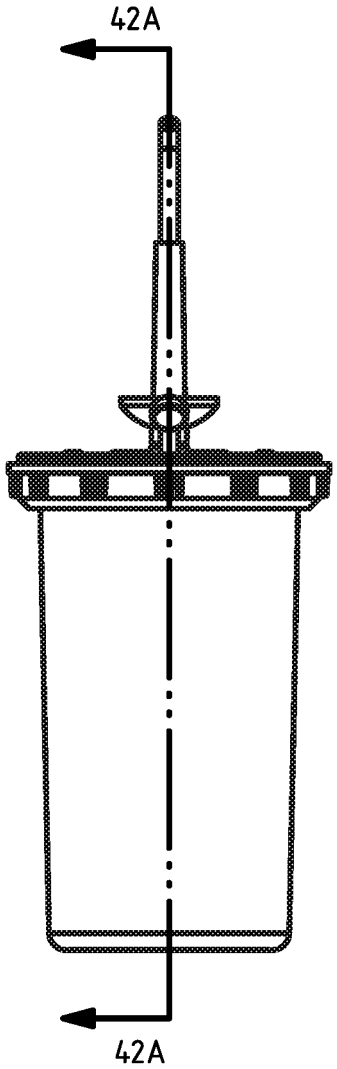

FIG. 42 is a plan view of Touch-up Paint Kit with Disposable Siphon Tube and Disposable Flexible Suction Tube attached.

Figure 42A:
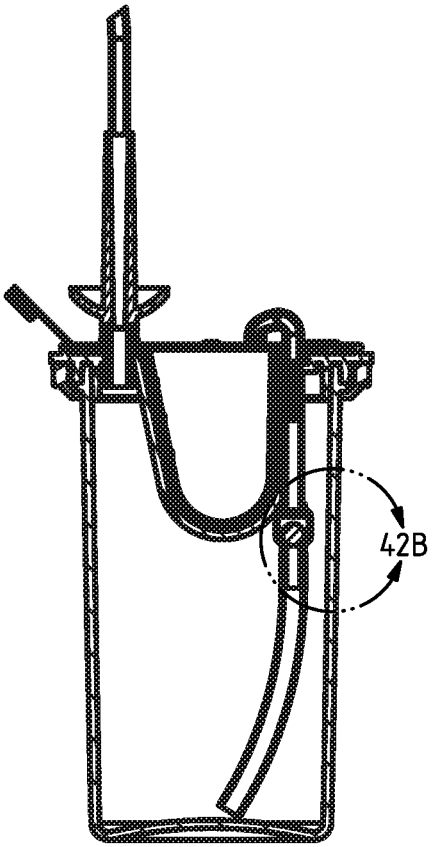

FIG. 42A is a cross section of FIG. 42 showing an alternative embodiment of Touch-up Paint Kit with a floating seal installed.

Figure 42B:
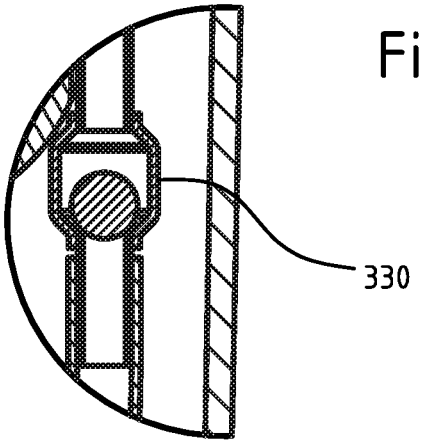

FIG. 42B is a detail of cross section FIG. 42A showing floating seal.

DRAWINGS—REFERENCE NUMERALS

100 Touch-Up Paint Kit
110 Top Cap
111 Diametrical Inner Edge Female Seal
120 Rotatable Pour Spout
121 Replaceable Pour Spout Tip
122 O-Ring
123 Rigid Tube
124 Flexible Tube
125 Pour Spout Vent
126 Rigid Tube Vent
127 Flexible Tube Vent
130 Disposable Paint Tray
131 Spherical Seal Boss
132 Scraping Blade
133 Snap-On Seal Cap
134 Flexible Cap Retainer Strap
135 Diametrical Inner Edge Female Seal
136 Flexible Hinge
137 Locating and Holding Recess
138 Foldable Section
139 Paint Retaining Wall
1391 Paint Tray Pocket
1392 Slot Clearance for Rotating Spout
1393 Hole Clearance for Trough Cap Tube
1394 Paint Roller Excess Paint Removal Surface
1395 Excess Paint Removal Boss
140 Trough Cap
141 Trough Cap Tube
142 Threaded Male Aspect
143 Trough Cap Tube Vent
144 Trough Cap Tube Connection
145 Trough Cap Diametrical Outer Edge Male Seal
146 Trough Cap Tube Diametrical Outer Edge Male Seal
147 Locating and Holding Boss
148 Diametrical Ring Sealing Surface
149 Diametrical Sealing Groove
1491 Trough Cap Pocket
1492 Hole Clearance for Rotating Spout
150 Cup (Also 150A, 150B, 150C, 150D)
151 Diametrical Sealing Ring
152 Diametrical Sealing Lip
153 Cup Interior
154 Cup Top
155 Cup Bottom
156 Cup Top Female Threaded
157 Cup Bottom Male Threaded
160 Threaded Locking Ring
161 Threaded Female Aspect
162 Diametrical Ring Sealing Surface
170 Disposable Siphon Tube
171 Paint Catching Recess

172 Disposable Siphon Tube Vent
173 Diametrical Inner Edge Female Seal
180 Disposable Paint Brush
181 Paint Brush Handle End
190 Disposable Paint Roller Assembly
191 Disposable Handle
192 Disposable Paint Roller
193 Extension Pocket
210 Carrying Tray
220 Rotatable Carrying Strap
230 Strap Lock
231 Strap Lock Slot
240 Peel and Stick Label
250 Disposable Flexible Suction Tube
251 Disposable Flexible Suction Tube Vent
260 Paint Can (Reference for demonstration of use of disclosed subject matter only)
270 Paint (Reference for demonstration of use of disclosed subject matter only)
280 Directional Arrow (Reference for flow or direction only, not part of embodiments)
290 Moisture Distributor
310 First Aperture
320 Second Aperture
330 Floating Seal DETAILED DESCRIPTION—FIG. 1 through FIG. 22 and FIG. 24 through FIG. 29 and FIG. 32 through FIG. 42B The presently disclosed subject matter will be described in detail hereinafter with reference to embodiments shown in the accompanying drawings.

Figure 1:
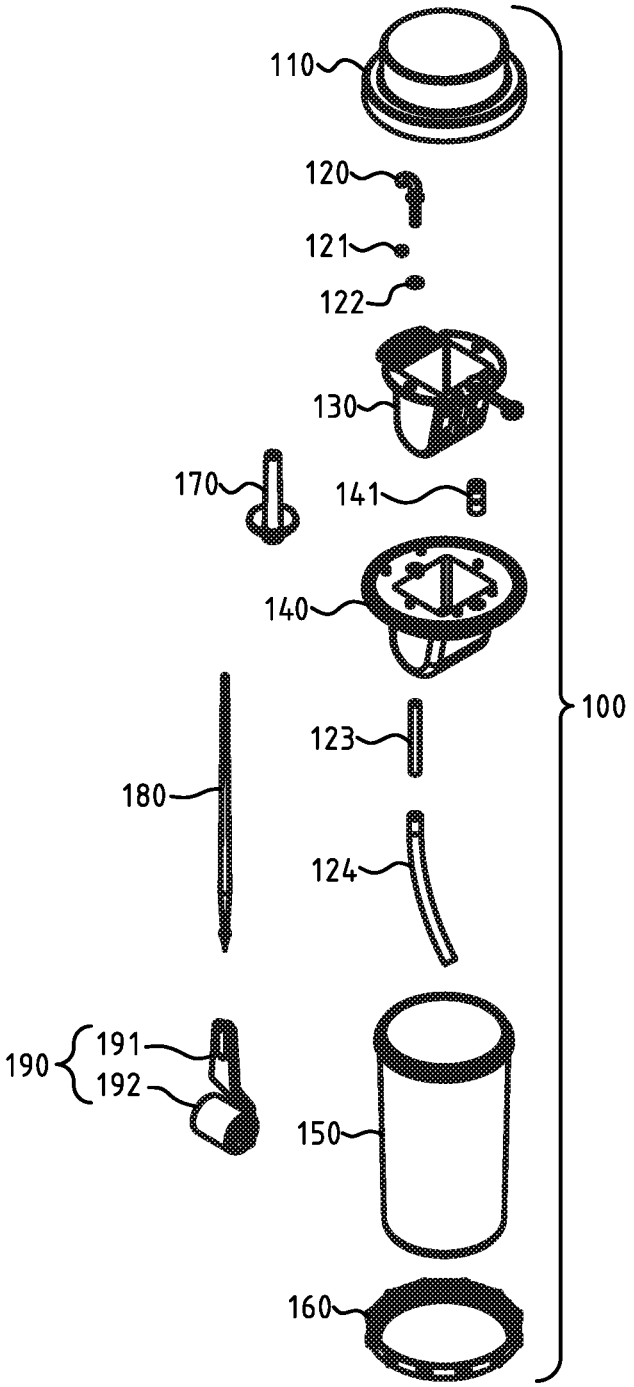
FIG. 1 shows an exploded view of an embodiment of a Touch-Up Paint Kit, with standard accessories, made in accordance with principles of the disclosed subject matter.

FIG. 1 illustrates an exploded perspective view of an embodiment of an assembly of a Paint Touch-Up Kit 100, accessories included, (and shown in FIG. 1), made in accordance with principles of the disclosed subject matter. FIG. 1 also shows Touch-Up Paint Kit 100 that includes a Cup 150, which is made of a flexible, transparent, somewhat compress-able material with good shape memory. Polypropylene would be one suitable choice of material for Cup 150, other plastics or polymers would also be acceptable. FIG. 1 also shows a Threaded Locking Ring 160 which can be made of any rigid material, acetal or any rigid plastic would be preferable although metal, glass and other materials could be used. FIG. 1 also shows a Trough Cap 140 which can be made of any rigid material including metal, glass, ceramic, plastic. Acetal plastic would be preferable. FIG. 1 also shows a Trough Cap Tube 141 which can be made of any rigid, non-stick material, Teflon is preferable, but many rigid materials with a smooth or polished surface, such as stainless steel would also be acceptable. In the present embodiment Trough Cap Tube 141 is shown as being over-molded/insert molded into Trough Cap 140 as part of an injection molding process but other attachment methods such as the use of threads, crimping, gluing would also facilitate attachment. Trough Cap Tube 141 could also be molded or fabricated as an integral part of Trough Cap 140, thus eliminating the need for a separate part. FIG. 1 also shows a Top Cap 110 which can be made of any flexible material, Polypropylene, Nylon, or other similar plastic preferable. FIG. 1 also shows a Rotatable Pour Spout 120 which can be made of any rigid material, metal, ceramic, ABS, Acrylonitile Butadiene Styrene, or some other similar plastic preferable. FIG. 1 also shows a Replaceable Pour Spout Tip 121 which can be made of any flexible, non-stick material, Teflon, and Polyethylene, or a rigid non-stick polished material such as stainless steel would be acceptable. When a flexible material is used for Replaceable Pour Spout Tip 121 a snap fit would be one way of removably attaching Replaceable Pour Spout Tip 121 to Rotatable Pour Spout 120. When a rigid material is used a threaded fit or an interference fit would be used to removably attach Replaceable Pour Spout Tip 121 to Rotatable Pour Spout 120. FIG. 1 also shows an O-Ring 122 which can be made from any chemical resistant O-ring rubber type material, including but not limited to neoprene, polyurethane, silicone, Viton. FIG. 1 also shows a Rigid Tube 123 which can be made of any rigid material, plastic, metal, stainless steel would be acceptable. FIG. 1 also shows a Flexible Tube 124 which can be made of any flexible, chemical resistant material such as PVC, or Rubber preferable. FIG. 1 also shows a Disposable Paint Tray 130 which can be made of a material that is flexible and has a "living hinge" capability so that it can flex along a hinge, a typical example of this "living hinge" would be a standard one-piece shampoo bottle cap where the top of cap can swing opened/closed along a hinge to over 180-degrees. Polypropylene would be a possible material. FIG. 1 also shows a Disposable Siphon Tube 170 which can be made from a flexible material with good shape memory, Polypropylene would be preferable, there are many flexible materials that would suffice, including nylon, and rubber. FIG. 1 also shows a Disposable Paint Brush 180 which is a typical Off-the-Shelf paint brush which is included in Touch-Up Paint Kit 100, any type of paint brush could be used. A custom fabricated paint brush could also be used. FIG. 1 also shows a Disposable Paint Roller Assembly 190 which is made of a Disposable Handle 191, which can be made from any plastic, metal, wood, ceramic or other rigid material, and a Disposable Paint Roller 192. Disposable Paint Roller 192 can be a typical Off-the-Shelf Disposable Paint Roller, or a custom roller can be fabricated from any of the many paint absorbent materials commonly available.

Figure 2:
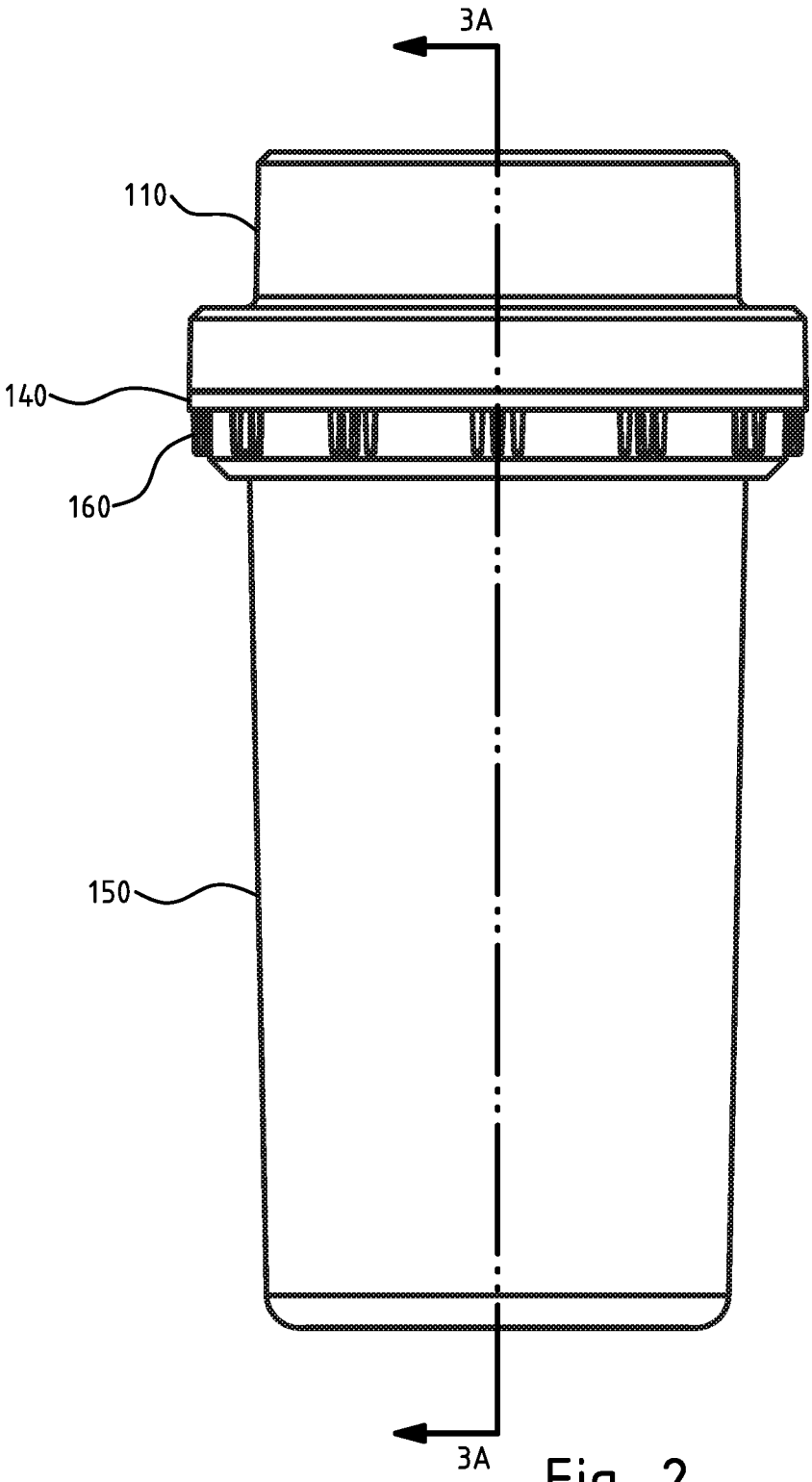
FIG. 2 is a plan view of an assembled embodiment of the disclosed subject matter showing four externally visible components of disclosed subject matter.

FIG. 2 shows a plan view of an embodiment of assembled Touch-Up Paint Kit 100, shown components are: Cup 150, Threaded Locking Ring 160, Trough Cap 140 and Top Cap 110. A more complete description to follow at the appropriate time.

Figure 3A:
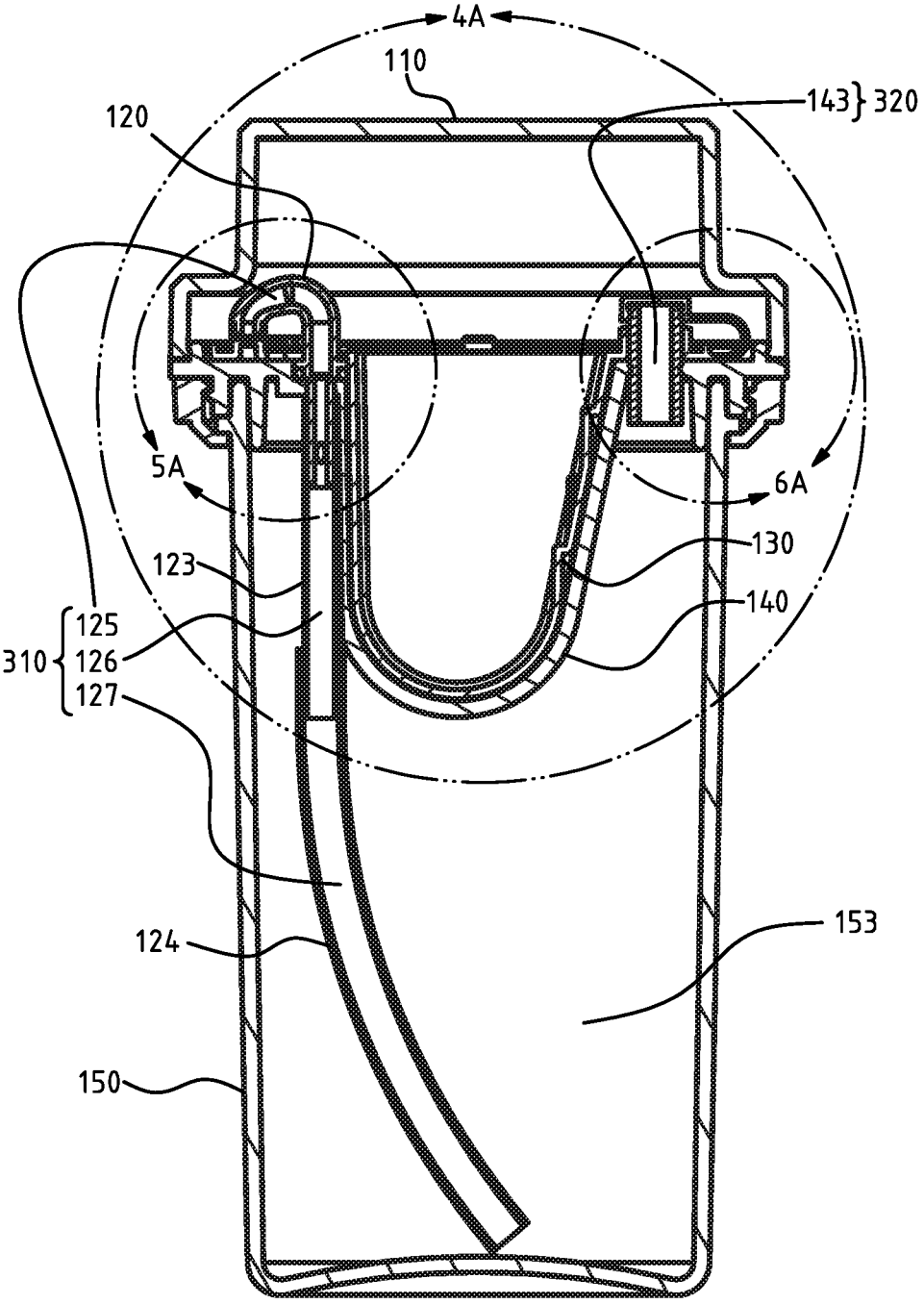
FIG. 3A is a cross section of FIG. 2 plan view showing internal components and two apertures.

FIG. 3A shows a cross section of FIG. 2 plan view, FIG. 3A also shows three detailed views which are, FIG. 4A, FIG. 5A, and FIG. 6A, and are to be more completely described in the following. A First Aperture 310 which seal-ably and unseal-ably connects a Cup Interior 153 of Cup 150 to external atmosphere, or external environment, is shown. First Aperture 310 is the result of the interconnection of multiple vents, in this embodiment these vents are, a Pour Spout Vent 125 of Rotatable Pour Spout 120, a Rigid Tube Vent 126 of Rigid Tube 123, and a Flexible Tube Vent 127 of Flexible Tube 124. FIG. 3A also shows a Second Aperture 320, in this embodiment Second Aperture 320, which seal-ably and unseal-ably also connects Cup Interior 153 of Cup 150 to external atmosphere, or external environment is shown. In this embodiment Second Aperture 320 is the result of a Trough Cap Tube Vent 143 of Trough Cap Tube 141 of Trough Cap 140.

Figure 4A:
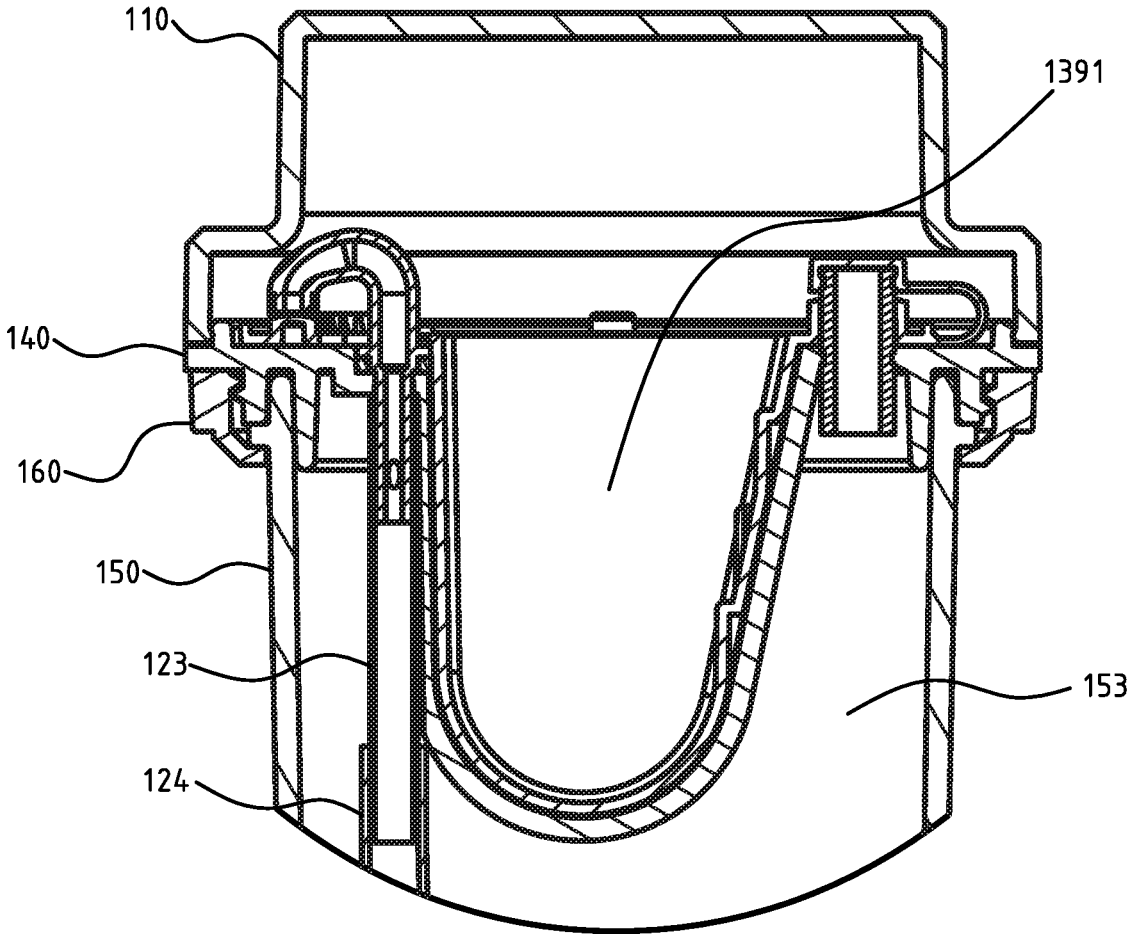
FIG. 4A is a detail of cross section FIG. 3A showing two paint storage areas.

FIG. 4A is a detail view of cross section shown in FIG. 3A and shows the locations of the two wet paint storage areas, Cup Interior 153 and a Paint Tray Pocket 1391. Rigid Tube 123 and Flexible Tube 124 are shown removably attached with the outside diameter of lower end of Rigid Tube 123 pressed into the inside diameter of the upper end of Flexible Tube 124. Other methods of attaching Rigid Tube 123 to Flexible Tube 124 include, but are not limited to, heat sealing, screwing, use of hose clamp or tie wrap.

Figure 5A:
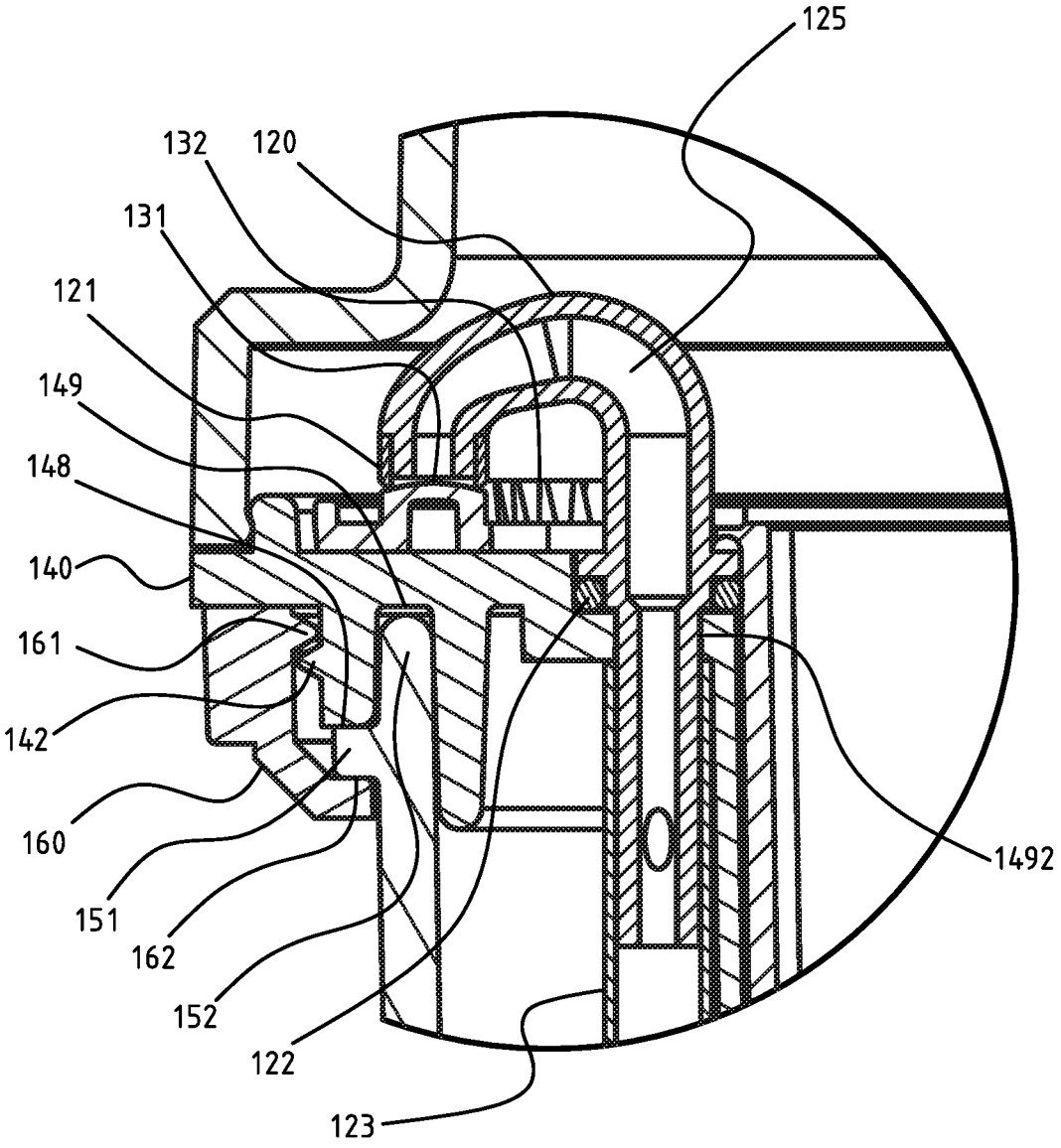
FIG. 5A is a smaller detail of detail FIG. 4A showing assembly details and features.

FIG. 5A shows another detail view of cross section shown in FIG. 3A and shows details of access of First Aperture 310, (shown in FIG. 3A), between external atmosphere and Cup Interior 153. Rotatable Pour Spout 120 is shown passing through O-Ring 122, Rotatable Pour Spout 120 is also shown passing through a Hole Clearance for Rotating Spout 1492, in Trough Cap 140. Inside diameter of Hole Clearance for Rotating Spout 1492 of Trough Cap 140 is the same size as outside diameter of Rotatable Pour Spout 120 where Trough Cap 140 and Rotatable Pour Spout 120 meet. In present embodiment lower end of Rotatable Pour Spout 120 is permanently attached to upper end of Rigid Tube 123, although it could also be removably attached. In this embodiment Rigid Tube 123 is permanently crimped onto Rotatable Pour Spout 120, other methods of attachment include, but are not limited to, gluing, or using male and female threads. During assembly, in this embodiment, this attachment is crimped in place when downward pressure is applied to top of Rotatable Pour Spout 120 which is then applying downward pressure on O-Ring 122 creating a substantially air tight seal to Cup Interior 153 as there is then constant pressure, or preload on O-Ring 122. FIG. 5A also shows Replaceable Pour Spout Tip 121 removably attached to the end of Rotatable Pour Spout 120 that is not exposed to Cup Interior 153. Replaceable Pour Spout Tip 121 sits on the outside of Rotatable Pour Spout 120 and does not block Pour Spout Vent 125. In this embodiment Replaceable Pour Spout Tip 121 is removably snapped onto Rotatable Pour Spout 120, Replaceable Pour Spout Tip 121 can also be attached to Rotatable Pour Spout 120 by other standard attaching methods including but not limited to, screwing on, or use a hose clamp. Note that in another embodiment, not shown, Replaceable Pour Spout Tip 121 can be an integral part of Rotatable Pour Spout 120 and thus part Replaceable Pour Spout Tip 121 could be eliminated. Replaceable Pour Spout Tip 121 is shown as a separate component in this present embodiment for its ease of use and re-use. Replaceable Pour Spout Tip 121 is shown seated on a Spherical Seal Boss 131 creating a substantially air tight seal to Cup Interior 153, sealing off First Aperture 310. Also shown is one of a plurality of a Scraping Blade 132, more on this to follow. FIG. 5A also shows the threading features which allow for sealing Trough Cap 140 onto Cup 150 with Threaded Locking Ring 160 by screwing a Threaded Female Aspect 161 of Threaded Locking Ring 160 onto a Threaded Male Aspect 142 of Trough Cap 140, thus clamping the top of Cup 150 between Threaded Locking Ring 160 and Trough Cap 140 creating at least three separate, redundant seals. One seal is created where a Diametrical Ring Sealing Surface 162 of Threaded Locking Ring 160 presses against the bottom of a Diametrical Sealing Ring 151 of Cup 150, another seal is created where a Diametrical Ring Sealing Surface 148 of Trough Cap 140 presses against the top of Diametrical Sealing Ring 151 of Cup 150, another seal is created where the tapered inner wall of a Diametrical Sealing Groove 149 presses against the tapered inner wall of a Diametrical Sealing Lip 152 of Cup 150. In this embodiment the tapers of Diametrical Sealing Groove 149 and Diametrical Sealing Lip 152 are parallel, although other non-parallel surfaces and surfaces of different shapes could also be used, thus creating a substantially air tight seal. This redundant substantially air tight sealing improves seal quality significantly. In this embodiment there are both male and female threads, but it is noted that one or the other of the threads could be replaced by guiding notches to guide the mating thread, and an interference snap fit could also be used to connect Threaded Locking Ring 160 to Trough Cap 140.

Figure 6A:
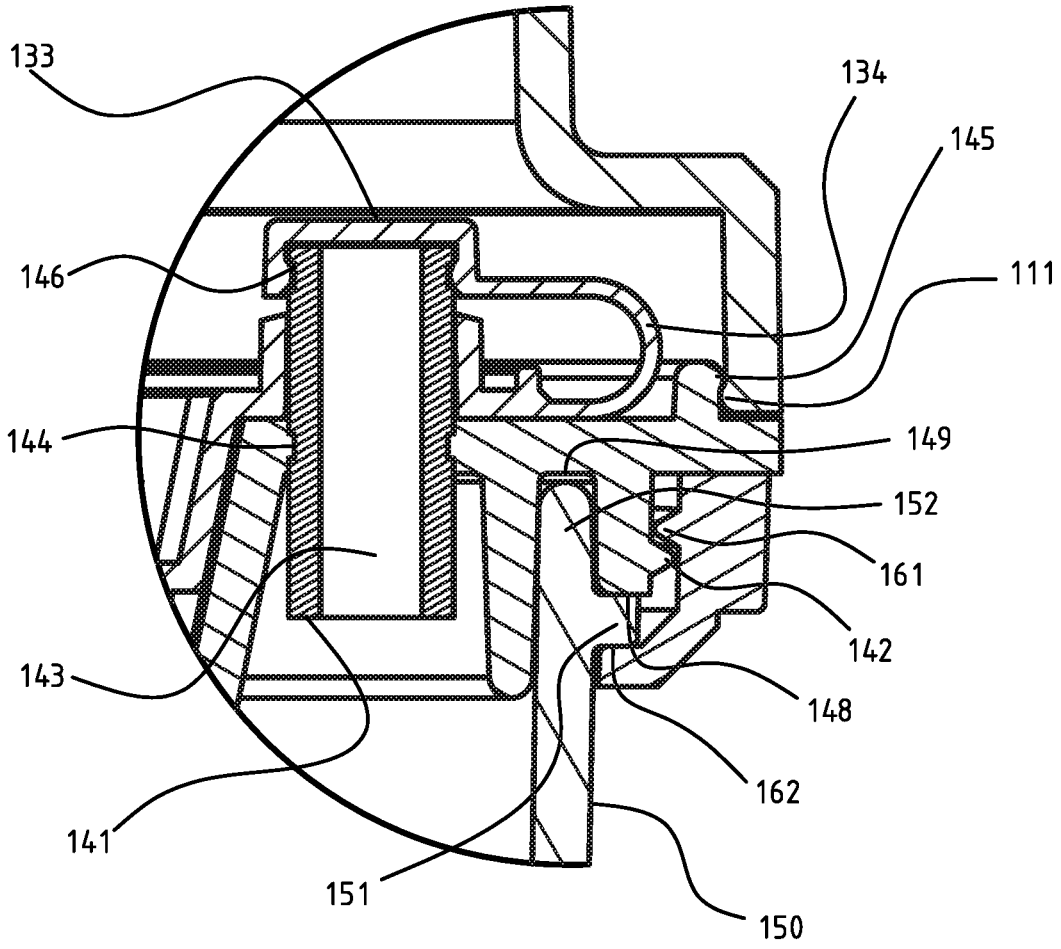
FIG. 6A is another smaller detail of detail FIG. 4A showing more assembly details and features.

FIG. 6A shows another detail view of cross section shown in FIG. 3A and shows details of access of Second Aperture 320, (also shown in FIG. 3A), between external atmosphere and Cup Interior 153. In this embodiment Trough Cap Tube 141 is permanently attached by a substantially air tight seal to Trough Cap 140 at a Trough Cap Tube Connection 144. As shown, Trough Cap 140 is over-molded, (insert-molded), onto Trough Cap Tube 141 at Trough Cap Tube Connection 144, but it could also be attached by other methods including but not limited to, gluing, and screwing on with male and female threads. With some attachment methods Trough Cap Tube 141 could also be removably attachable. Also shown in FIG. 6A is Trough Cap Tube Vent 143 of Trough Cap Tube 141 which creates Second Aperture 320 to Cup Interior 153. A Snap-On Seal Cap 133 of Disposable Paint Tray 130 which is movable and rotatable via a Flexible Cap Retainer Strap 134 of same Disposable Paint Tray 130 is removably attached by a Diametrical Inner Edge Female Seal 135, (shown in FIG. 8), of Disposable Paint Tray 130 to a Trough Cap Tube Diametrical Outer Edge Male Seal 146 of Trough Cap Tube 141 creating a substantially air tight seal to Cup Interior 153. Trough Cap Tube 141 is shown passing through a Hole Clearance for Trough Cap Tube 1393, (shown in FIG. 24). FIG. 6A also shows a Diametrical Inner Edge Female Seal 111 of Top Cap 110 and a Trough Cap Diametrical Outer Edge Male Seal 145, more on this to follow.

Figure 7:
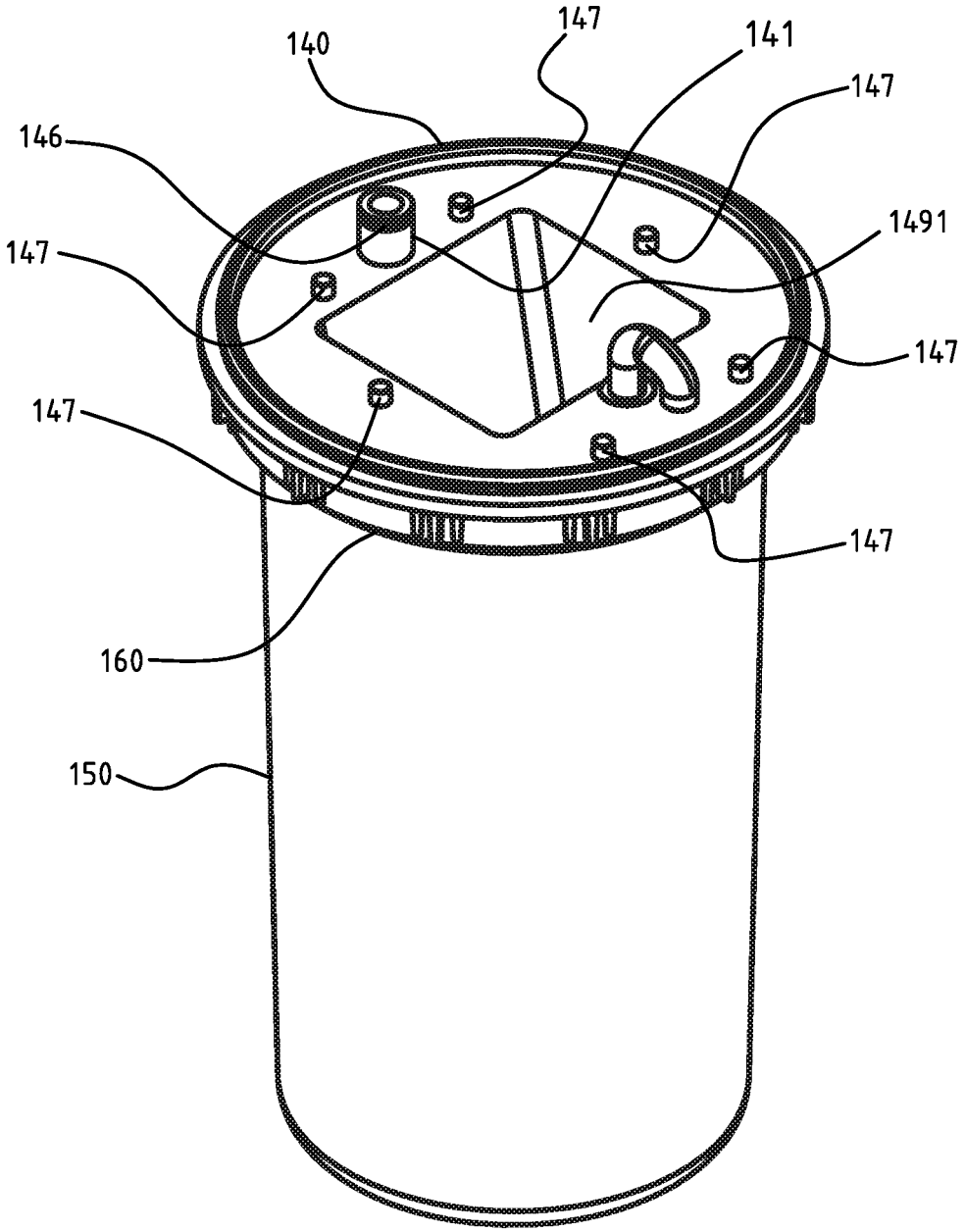
FIG. 7 is a perspective view of partial assembly of an embodiment of the disclosed subject matter in preparation to receive a Disposable Paint Tray.

FIG. 7 shows a perspective view of a partial assembly of an embodiment of the disclosed subject matter. Pluralities of a Locating and Holding Boss 147 of Trough Cap 140 are shown. In this embodiment there are a total of six Locating and Holding Boss 147, but other quantities, both lower and higher, would also be acceptable. A Trough Cap Pocket 1491 is also shown.

Figure 8:
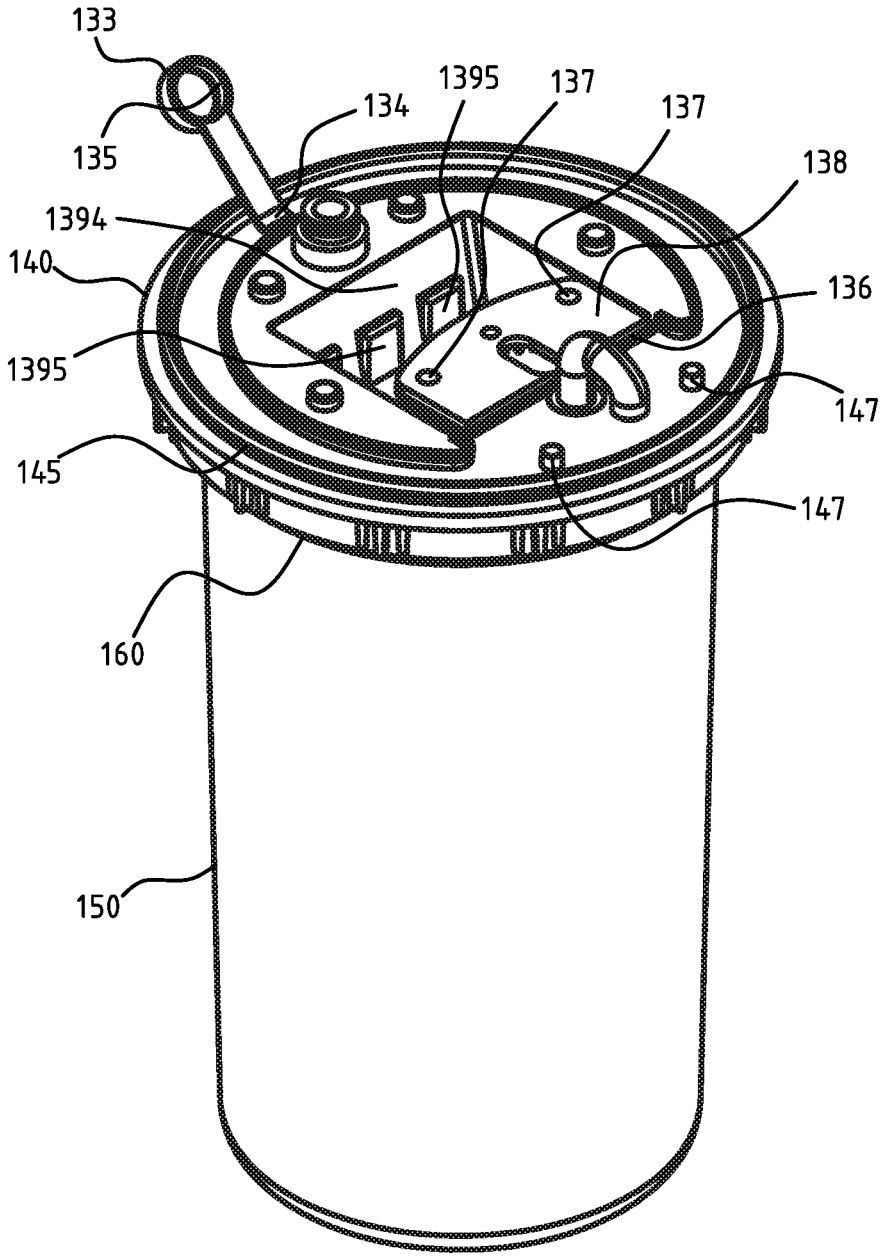
FIG. 8 is a perspective view with a step in the assembly for usage of disclosed subject matter with a Disposable Paint Tray partially installed.

FIG. 8 shows a perspective view of another partial assembly of an embodiment of the disclosed subject matter and shows a Paint Roller Excess Paint Removal Surface 1394 of Disposable Paint Tray 130, FIG. 8 also shows a plurality of an Excess Paint Removal Boss 1395.

Figure 9:
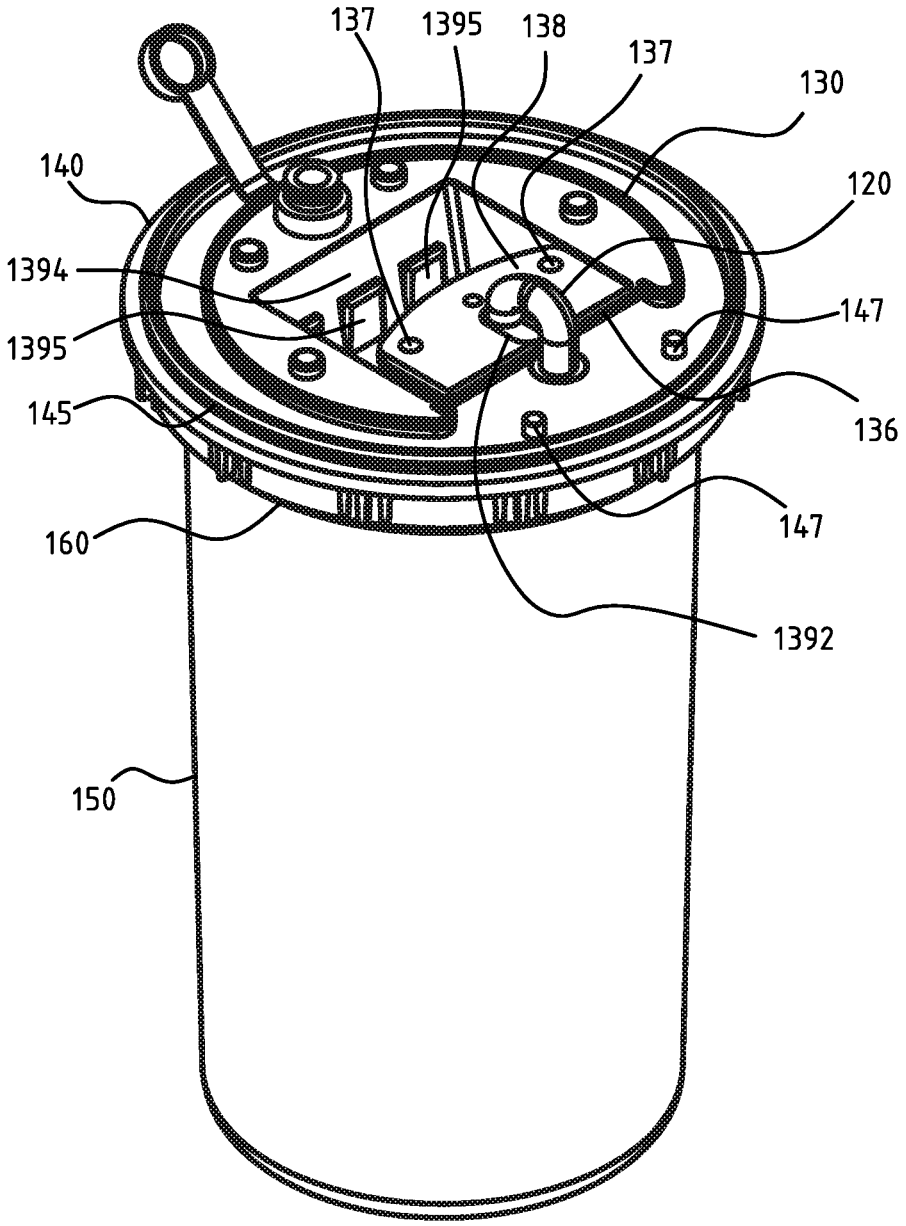
FIG. 9 is a perspective view with another step in the assembly for usage of disclosed subject matter with a Disposable Paint Tray partially installed and a Pour Spout rotated to continue installation.

FIG. 9 shows a perspective view of another partial assembly of an embodiment of the disclosed subject matter. Rotatable Pour Spout 120 is shown rotated towards center of Cup 150 and is located centered over a Slot Clearance for Rotating Spout 1392, (shown in FIG. 25), of Disposable Paint Tray 130.

Figure 10:
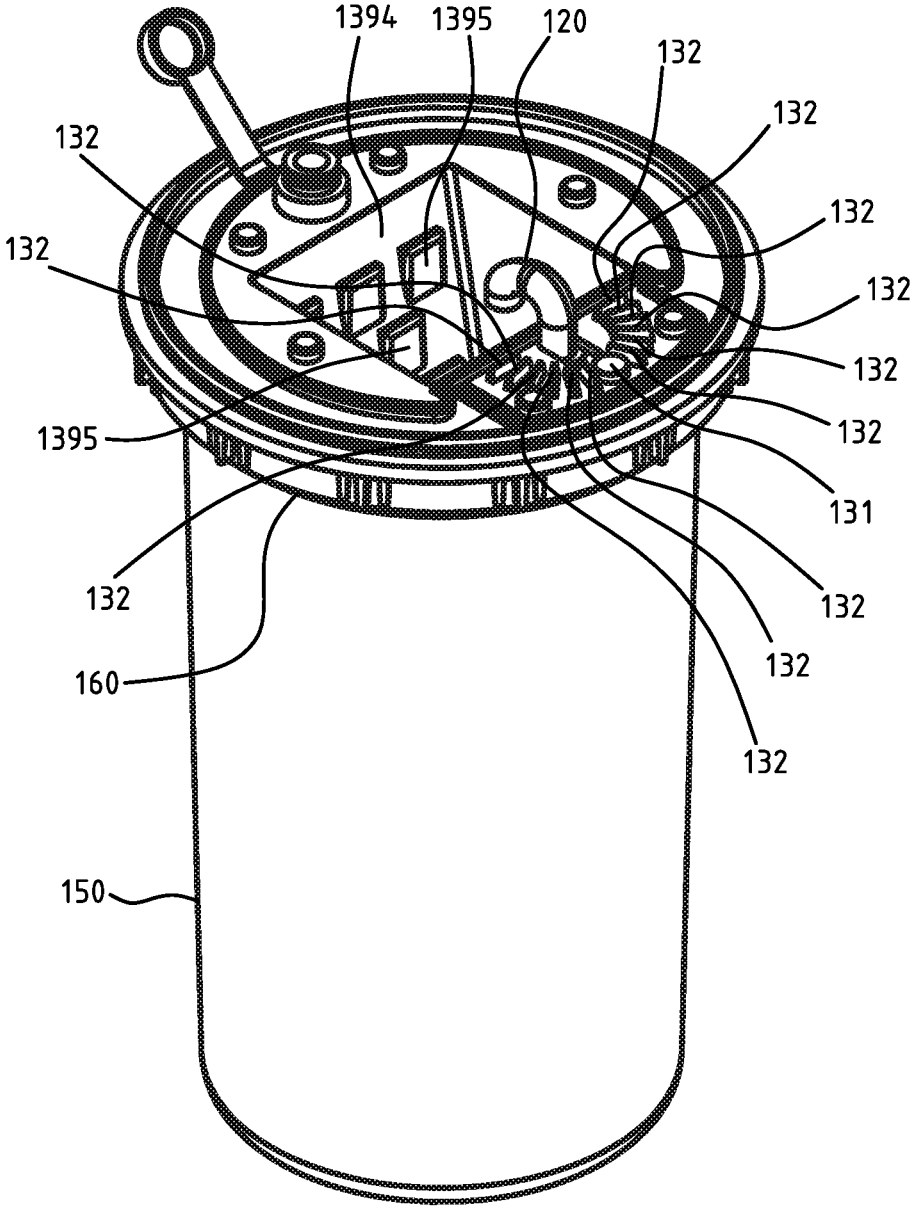
FIG. 10 is a perspective view with another step in the assembly for usage of disclosed subject matter with Disposable Paint Tray partially installed and a Foldable Section unfolded to continue installation.

FIG. 10 shows a perspective view of another partial assembly of an embodiment of the disclosed subject matter. A Foldable Section 138 is shown in the unfolded position. Also shown are the pluralities of Scraping Blade 132 located on both sides of Spherical Seal Boss 131.

Figure 11:
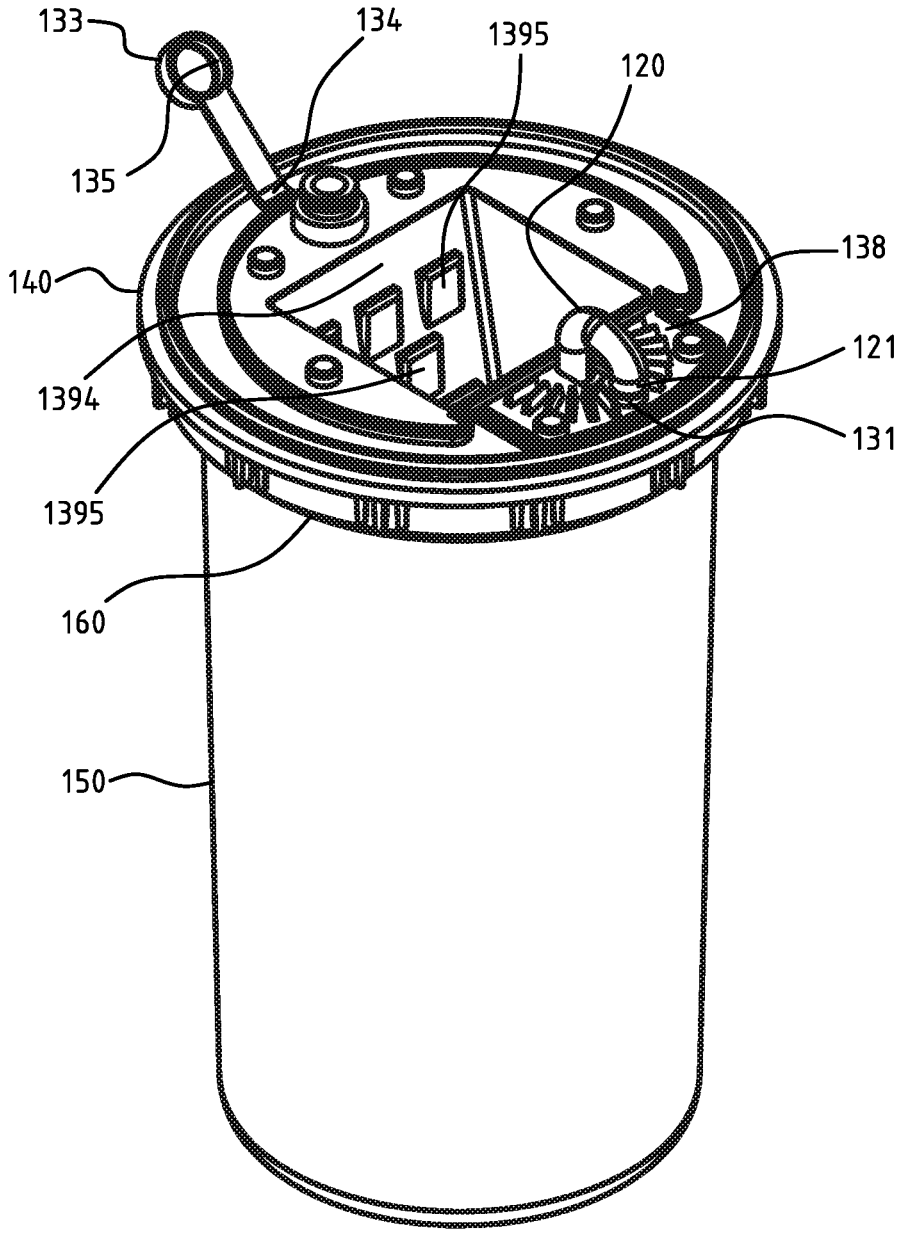
FIG. 11 is a perspective view with another step in the assembly for usage of disclosed subject matter with a Disposable Tray fully installed and Pour Spout rotated to seal one aperture.

FIG. 11 shows a perspective view of another partial assembly of an embodiment of the disclosed subject matter. Rotatable Pour Spout 120 is shown rotated outward and away from center of Cup 150 and seated on Spherical Seal Boss 131 creating a substantially air tight seal of Cup Interior 153.

Figure 12:
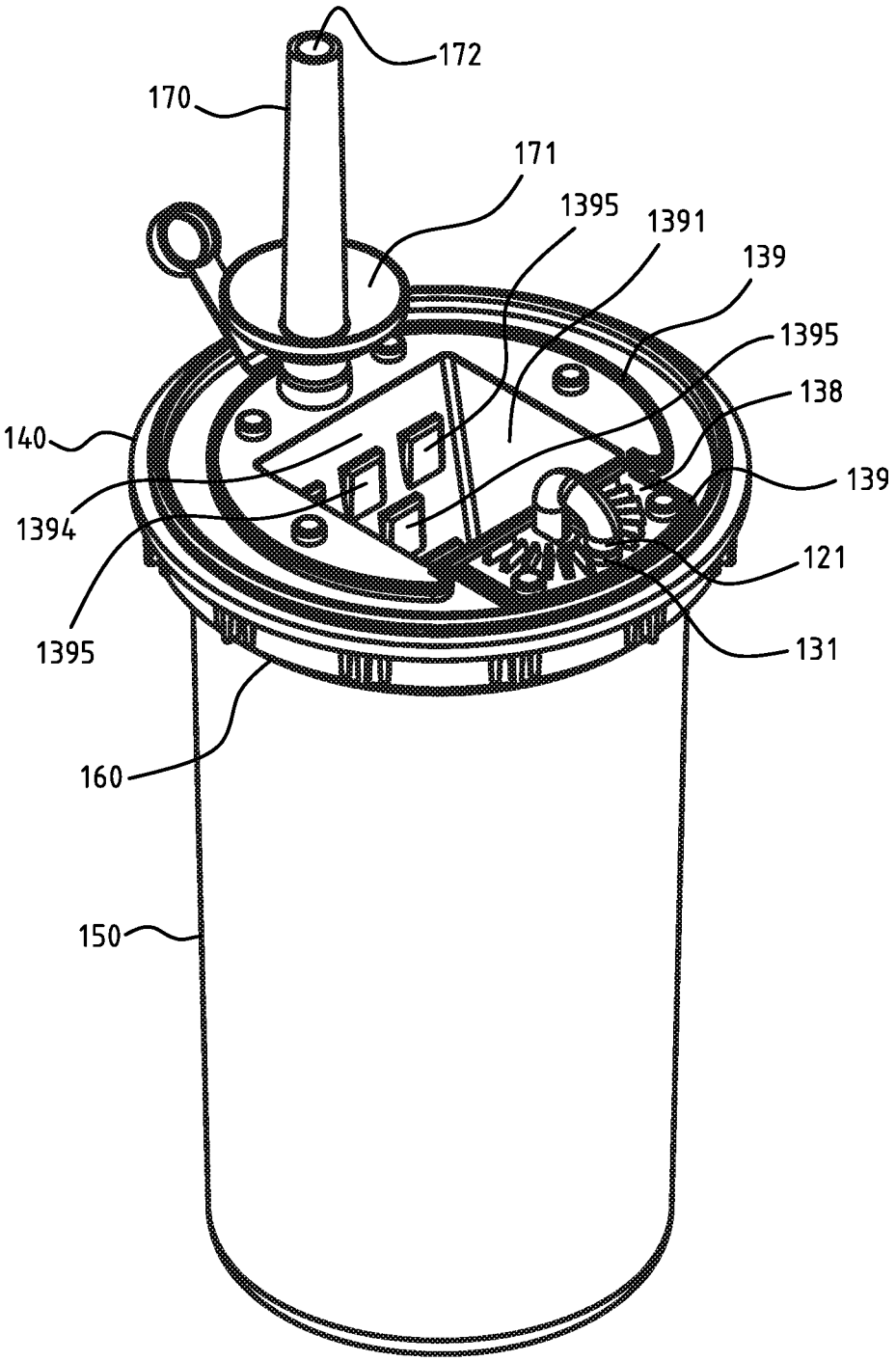
FIG. 12 is a perspective view with a step in the assembly for usage of disclosed subject matter with one aperture sealed and another aperture open and with a Siphon Tube attached in preparation to receive paint from an external source.

FIG. 12 shows a perspective view of another partial assembly of an embodiment of the disclosed subject matter. Rotatable Pour Spout 120 is again shown rotated outward and away from center of Cup 150 and seated on Spherical Seal Boss 131 maintaining a substantially air tight seal of Cup Interior 153. Disposable Siphon Tube 170 is shown removably attached to Trough Cap Tube 141 by a Diametrical Inner Edge Female Seal 173, (shown in FIG. 26A), at Trough Cap Tube Diametrical Outer Edge Male Seal 146, (shown in FIG. 7). FIG. 12 also shows a plurality of a Paint Retaining Wall 139 of Disposable Paint Tray 130.

Figure 13:
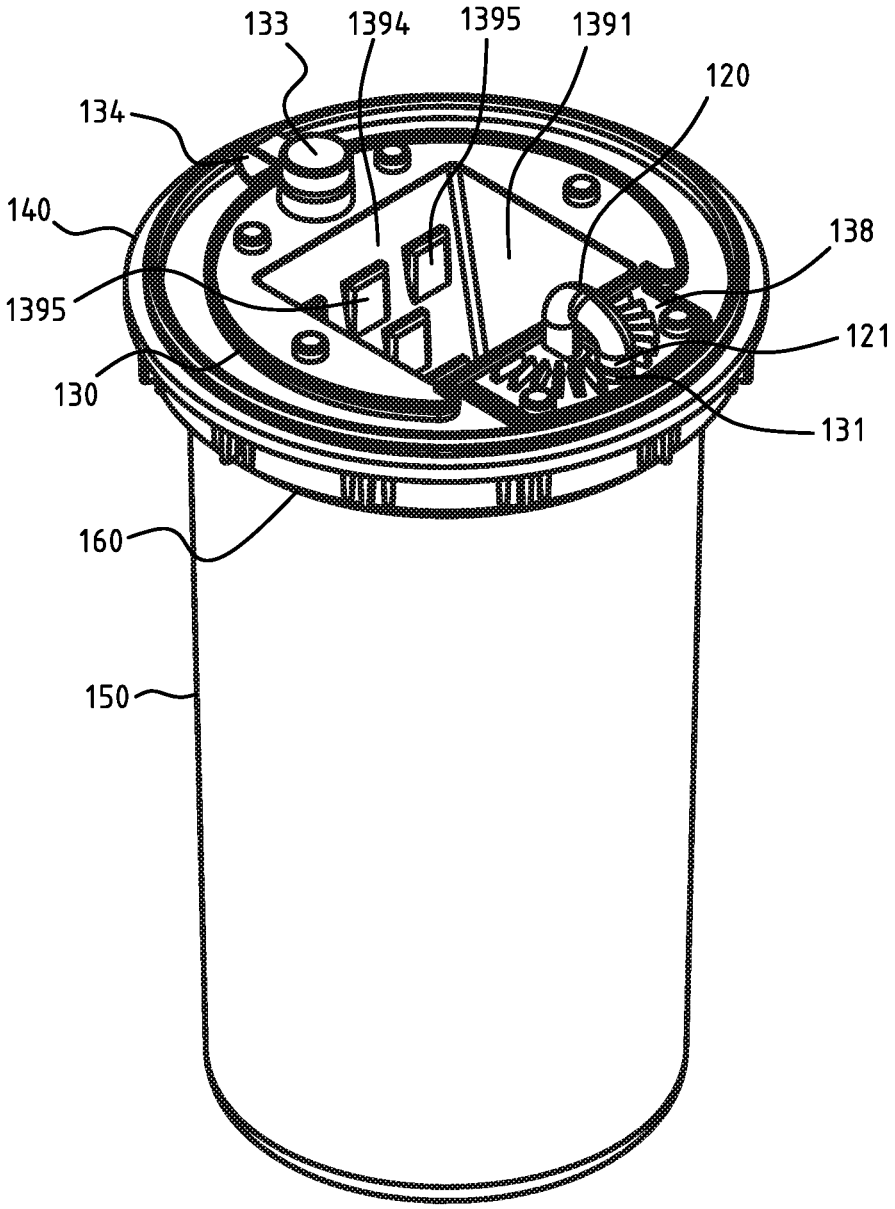
FIG. 13 is a perspective view with a step in the assembly for usage of disclosed subject matter with two apertures sealed to store paint.

FIG. 13 shows a perspective view of another partial assembly of an embodiment of the disclosed subject matter where Cup Interior 153 is substantially sealed from external atmosphere, more to follow.

Figure 14:
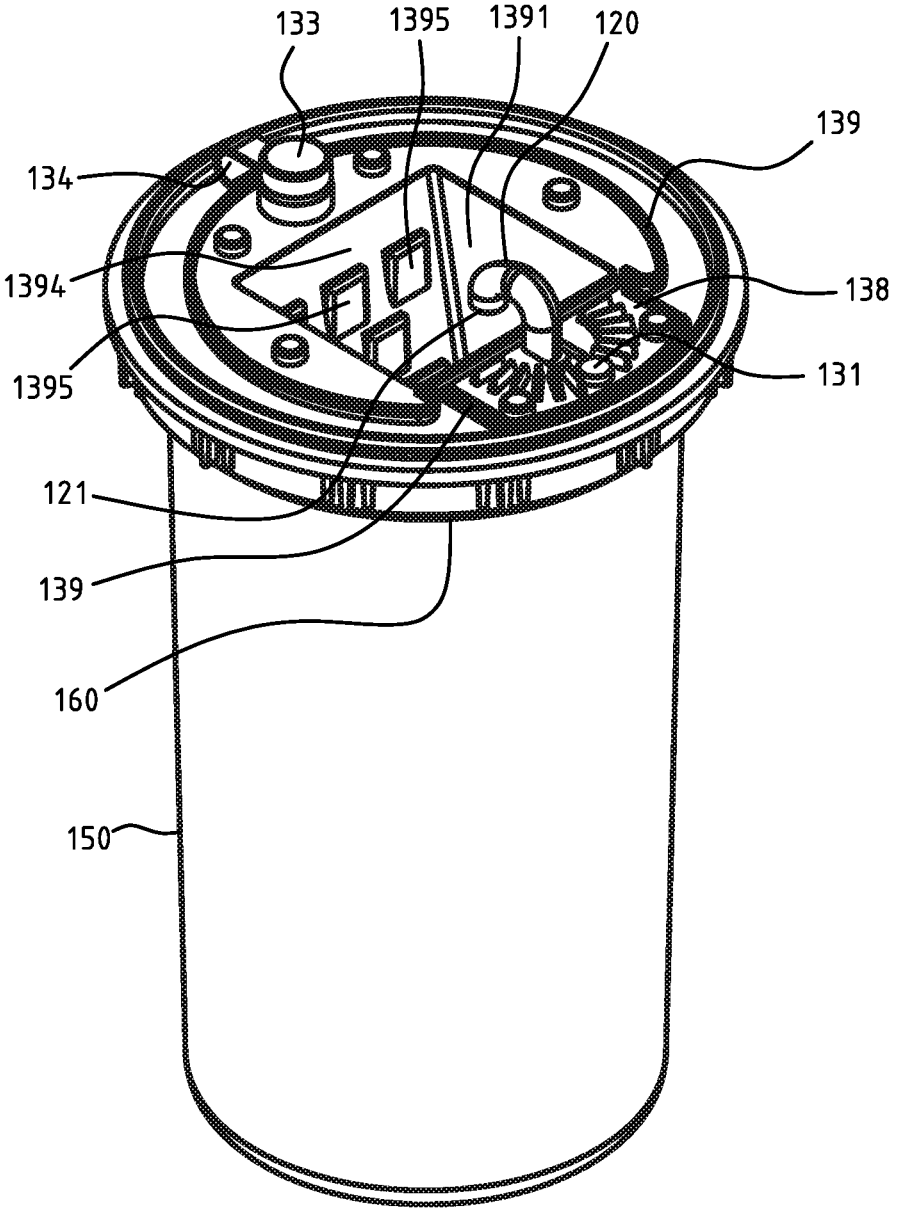
FIG. 14 is a perspective view with another step in the assembly for usage of disclosed subject matter with one aperture closed and another opened to transfer paint from one paint storage area to another paint storage area.

FIG. 14 shows a perspective view of another partial assembly of an embodiment of the disclosed subject matter where Cup Interior 153 is open to, exposed to, external atmosphere at First Aperture 310, (shown in FIG. 3A), more to follow.

Figure 15:
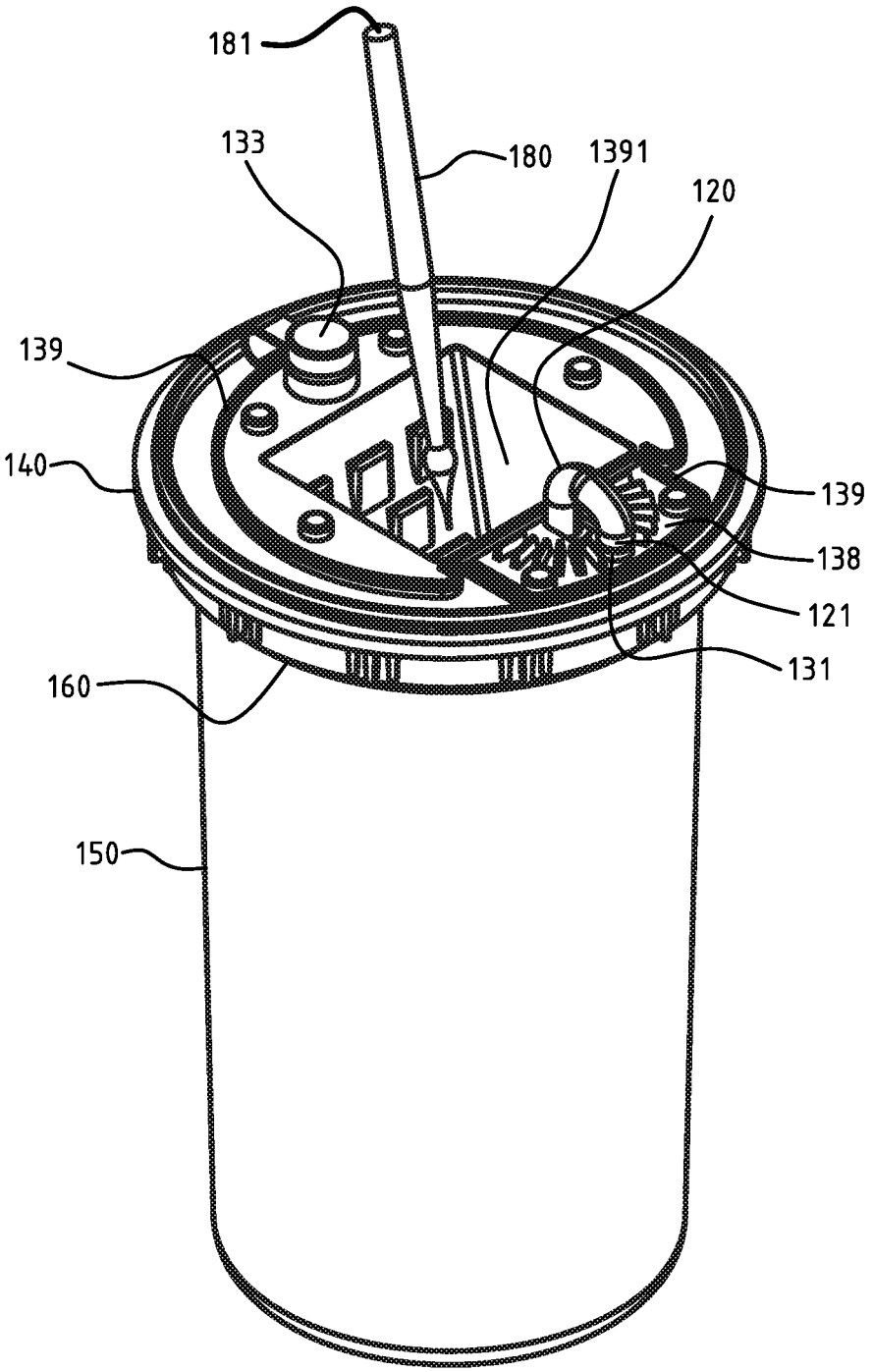
FIG. 15 is a perspective view of another step in the assembly for usage of disclosed subject matter with both apertures closed, including a method of applying paint.

FIG. 15 shows a perspective view of an embodiment of the disclosed subject matter where Disposable Paint Brush 180 is shown in proximity to Paint Tray Pocket 1391. In this embodiment a Paint Brush Handle End 181 is also shown.

Figure 16:
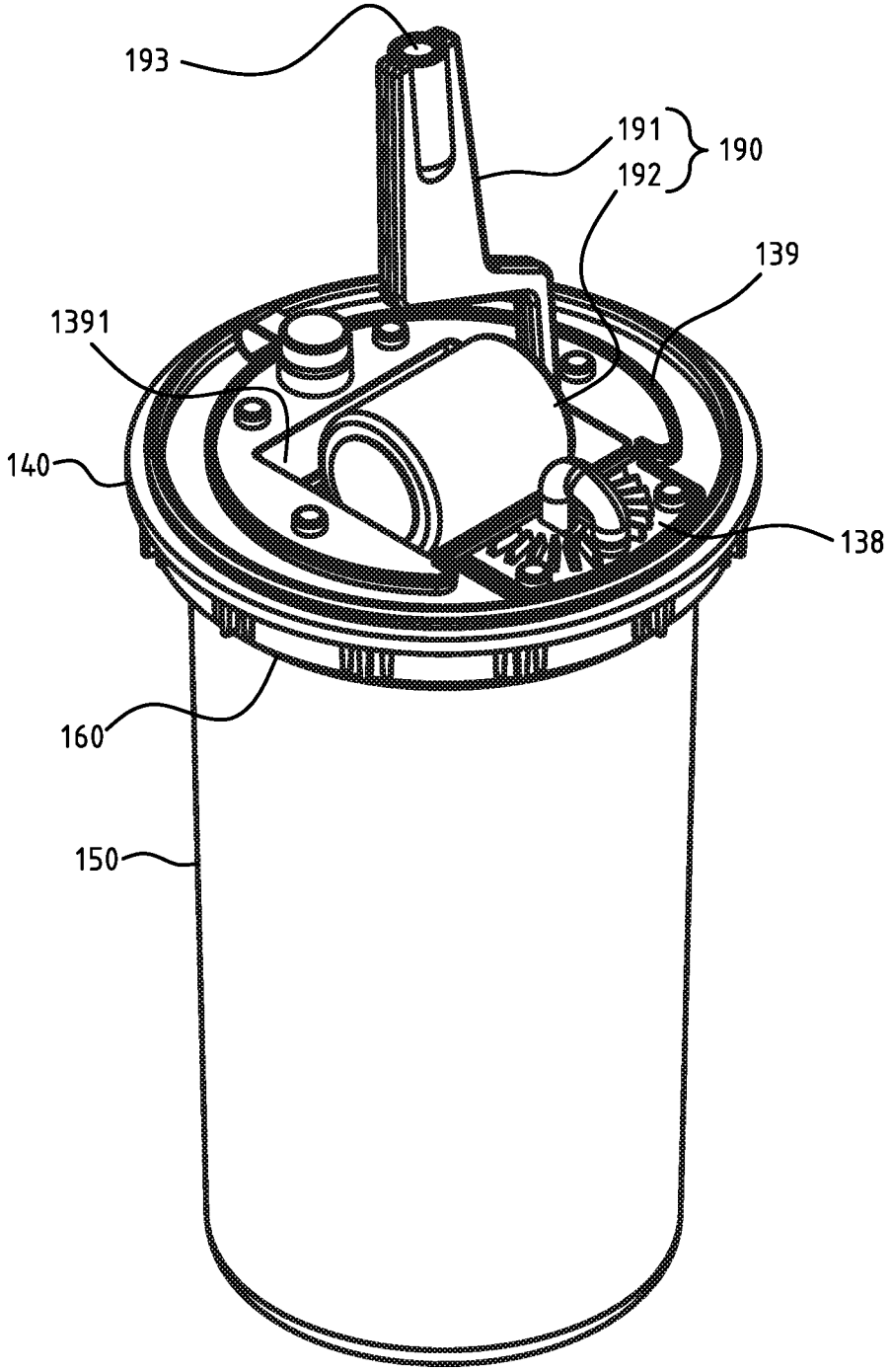
FIG. 16 shows another method of applying paint through use of disclosed subject matter.

FIG. 16 shows a perspective view of an embodiment of the disclosed subject matter where Disposable Paint Roller Assembly 190 is shown in proximity to Paint Tray Pocket 1391. An Extension Pocket 193 of Disposable Handle 191 is also shown.

Figure 17:
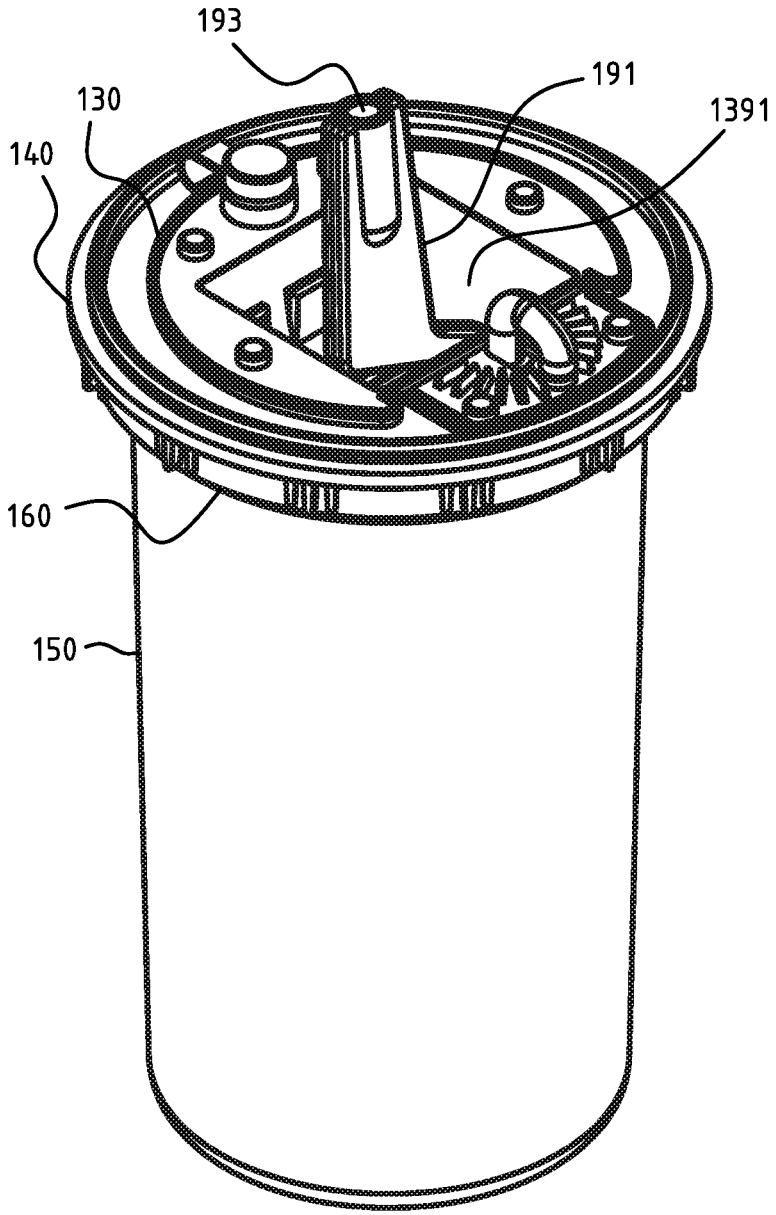
FIG. 17 shows a method of placing a Paint Roller Assembly in a Paint Tray Pocket allowing for storage of Paint Roller Assembly with wet paint on its Disposable Paint Roller, FIG. 17 also shows a hole at end of paint roller handle to receive a paint brush handle for better reach when touch-up painting.

FIG. 17 shows another perspective view of an embodiment of the disclosed subject matter where Disposable Paint Roller Assembly 190 is shown in closer proximity to Paint Tray Pocket 1391.

Figure 18:
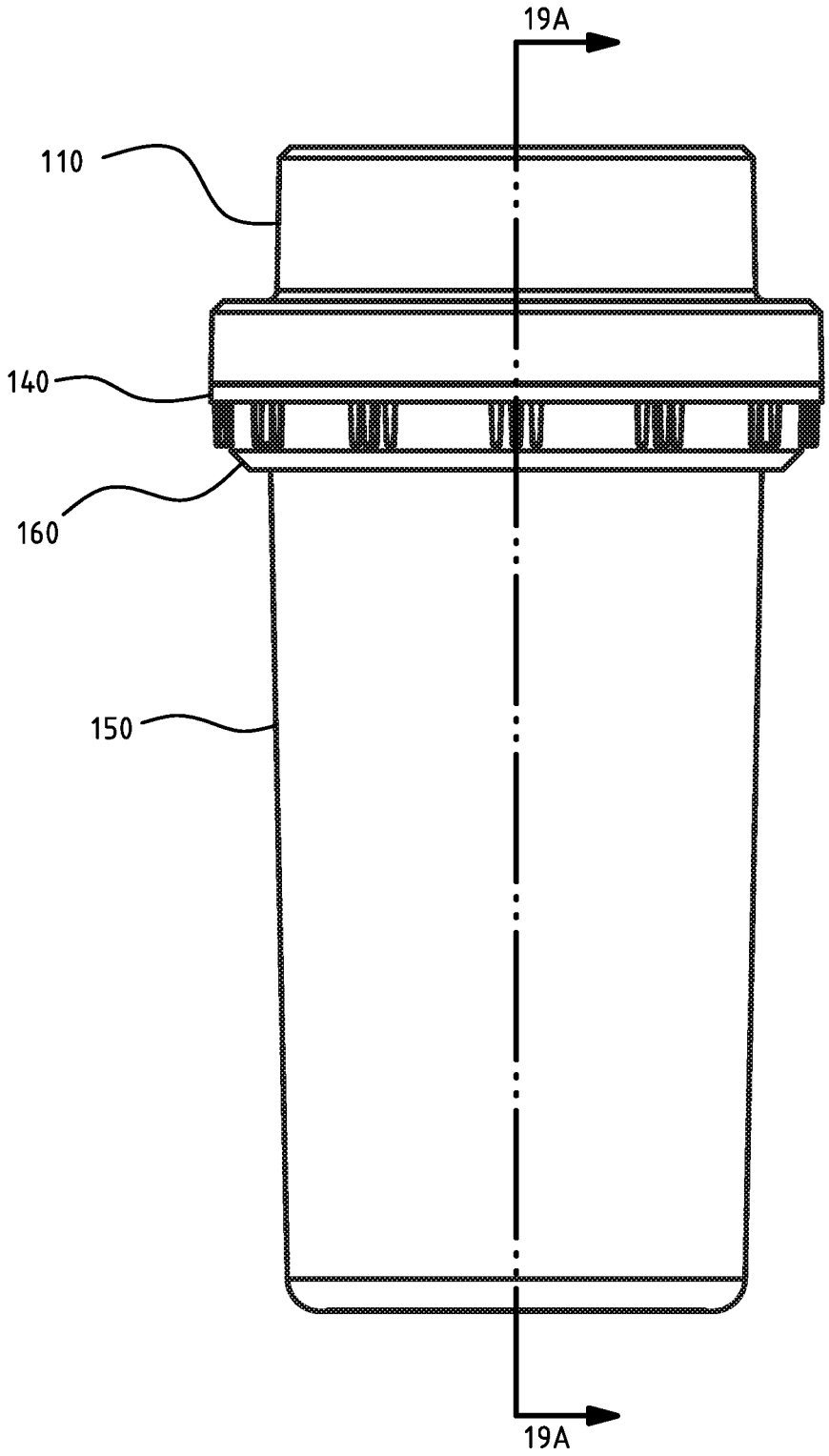
FIG. 18 shows a plan view of an embodiment of disclosed subject matter with a Top Cap installed.

FIG. 18 is a plan view of Touch-Up Paint Kit 100. Top Cap 110 is installed onto Trough Cap 140. Cup 150, and Threaded Locking Ring 160 are also shown.

Figure 19A:
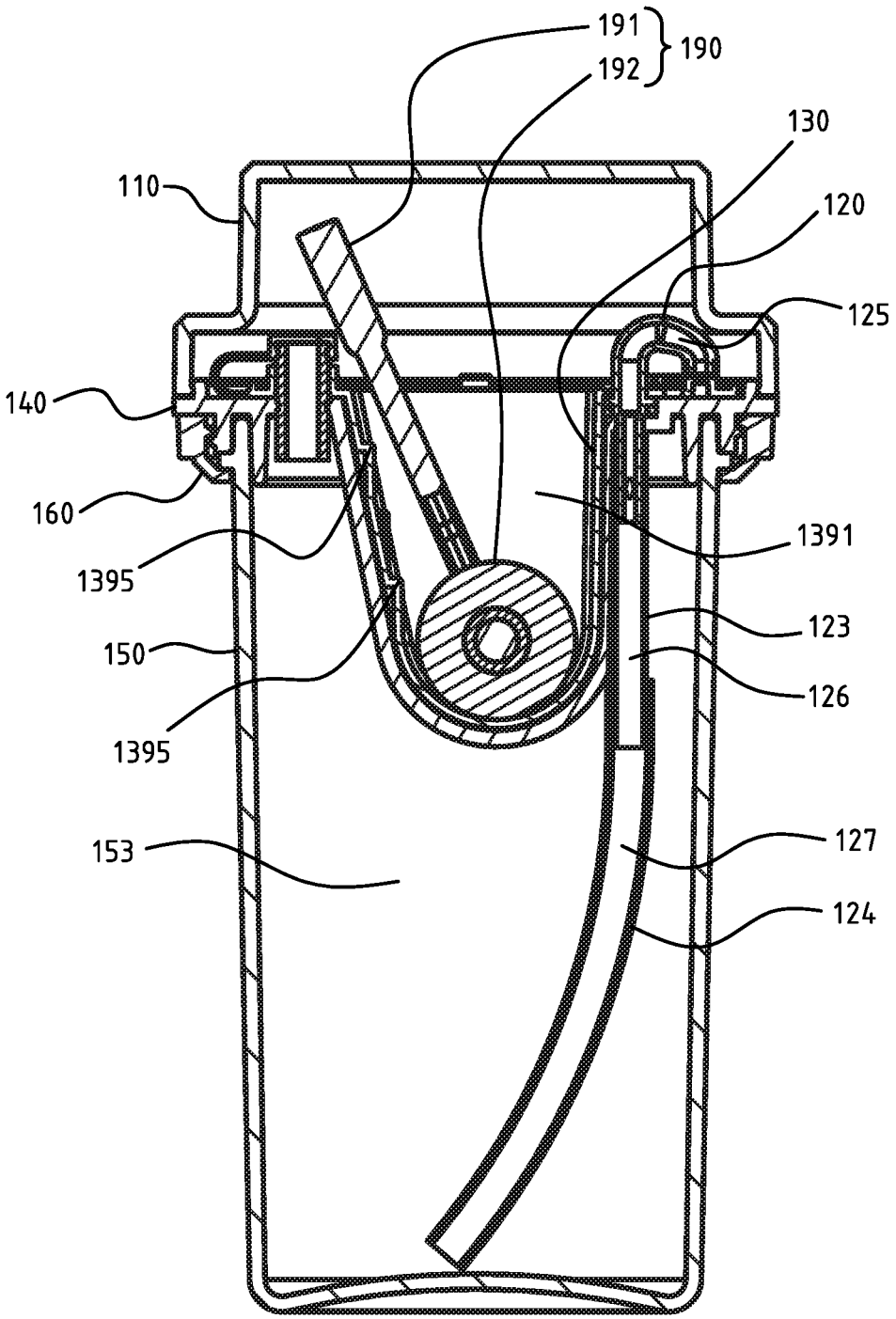
FIG. 19A is a cross section of FIG. 18 plan view showing a Paint Roller stored and with Paint Roller seated in a Paint Tray Pocket.

FIG. 19A shows a Cross Section of FIG. 18 plan view, including the stored/stowed Disposable Paint Roller Assembly 190, more on this to follow. A full view of vent created by Flexible Tube Vent 127, Rigid Tube Vent 126, and Pour Spout Vent 125 is also shown, (also shown in FIG. 3A).

Figure 20:
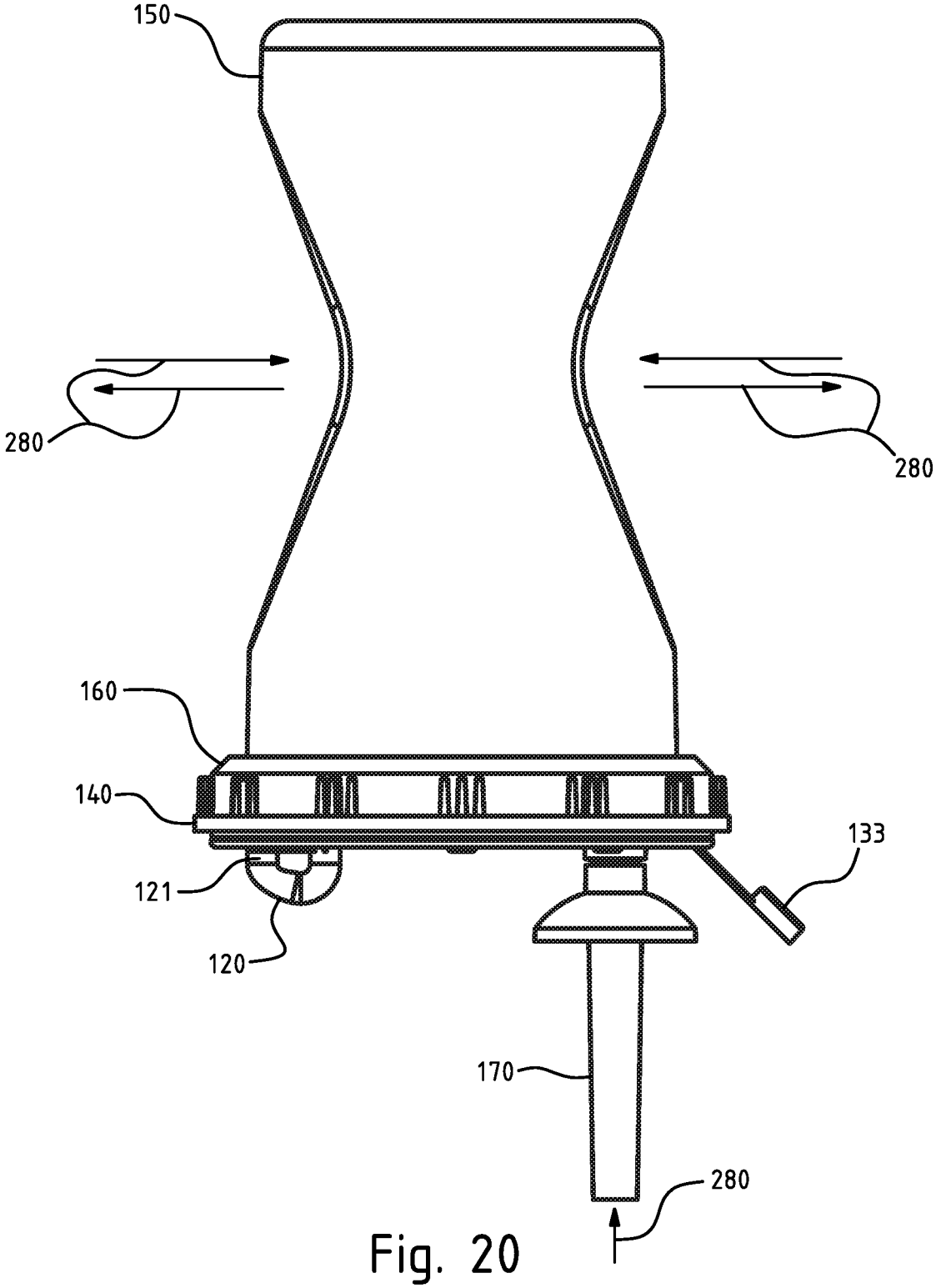
FIG. 20 shows a plan view of usage of a Cup squeezed and prepared to receive paint from an external source with one aperture sealed and another open through shown siphon tube.

FIG. 20 is a plan view of Touch-Up Paint Kit 100 with Touch-Up Paint Kit 100 shown inverted with Disposable Siphon Tube 170 attached to Trough Cap Tube 141 and Disposable Siphon Tube 170 pointing downward. Rotatable Pour Spout 120 is shown in the sealed position, thus sealing First Aperture 310. Second Aperture 320 is open and passing through a Disposable Siphon Tube Vent 172, (shown in FIG. 26A), of Disposable Siphon Tube 170, and Second Aperture 320 also passing through Trough Cap Tube Vent 143, (shown in FIG. 3A), in this embodiment.

Figure 21:
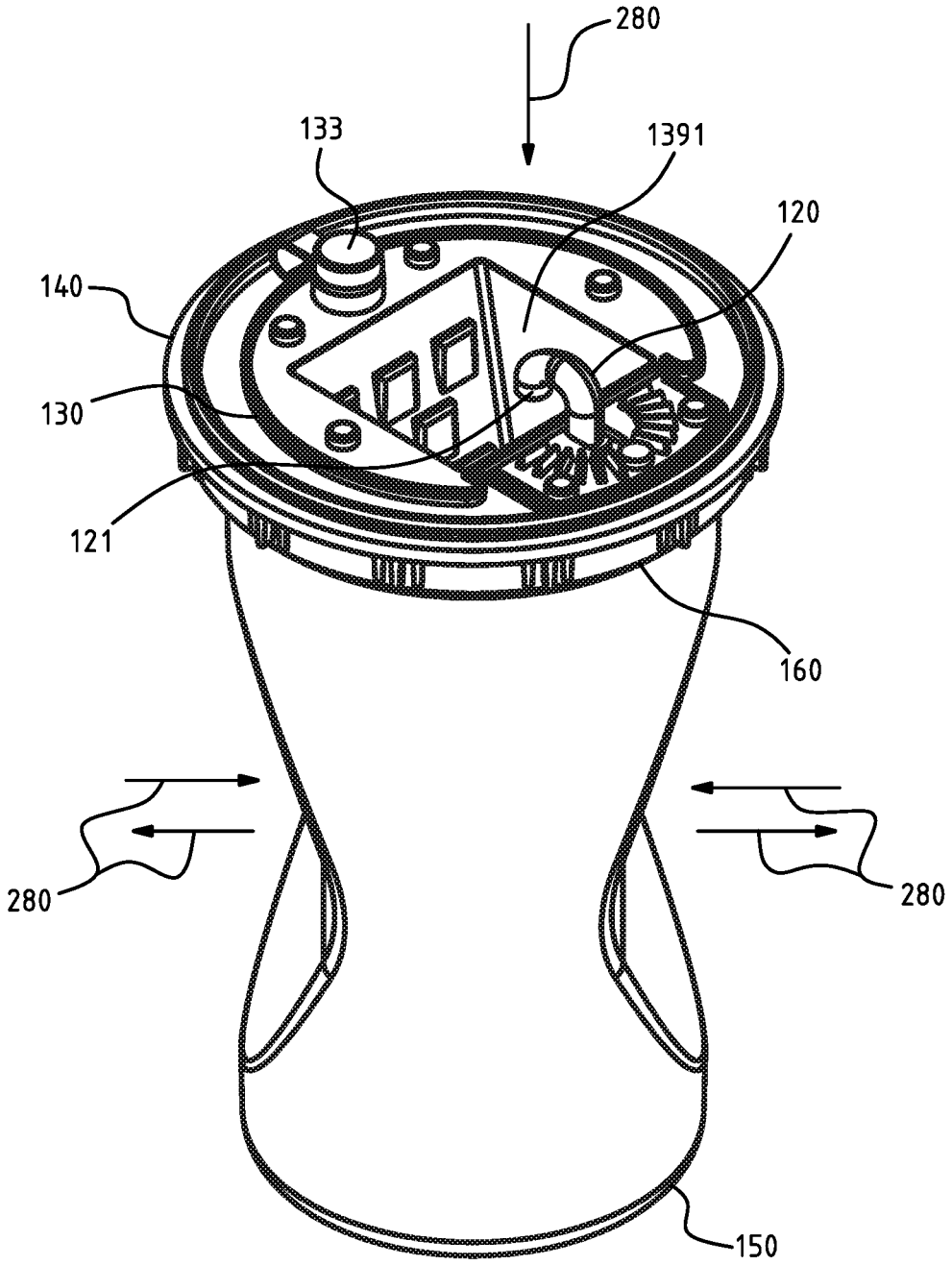
FIG. 21 shows a perspective view of usage of Cup being squeezed and transferring paint from one paint storage area to another paint storage area with one aperture closed and another open through a pour spout in preparation to doing touch-up painting.

FIG. 21 shows another perspective view of an embodiment of disclosed subject matter where Snap-On Seal Cap 133 is removably attached to Trough Cap Tube 141 substantially sealing off Second Aperture 320, more on this to follow. Rotatable Pour Spout 120 is shown rotated towards center of Cup 150 and over Paint Tray Pocket 1391 thus opening First Aperture 310, more on this to follow.

Figure 22:
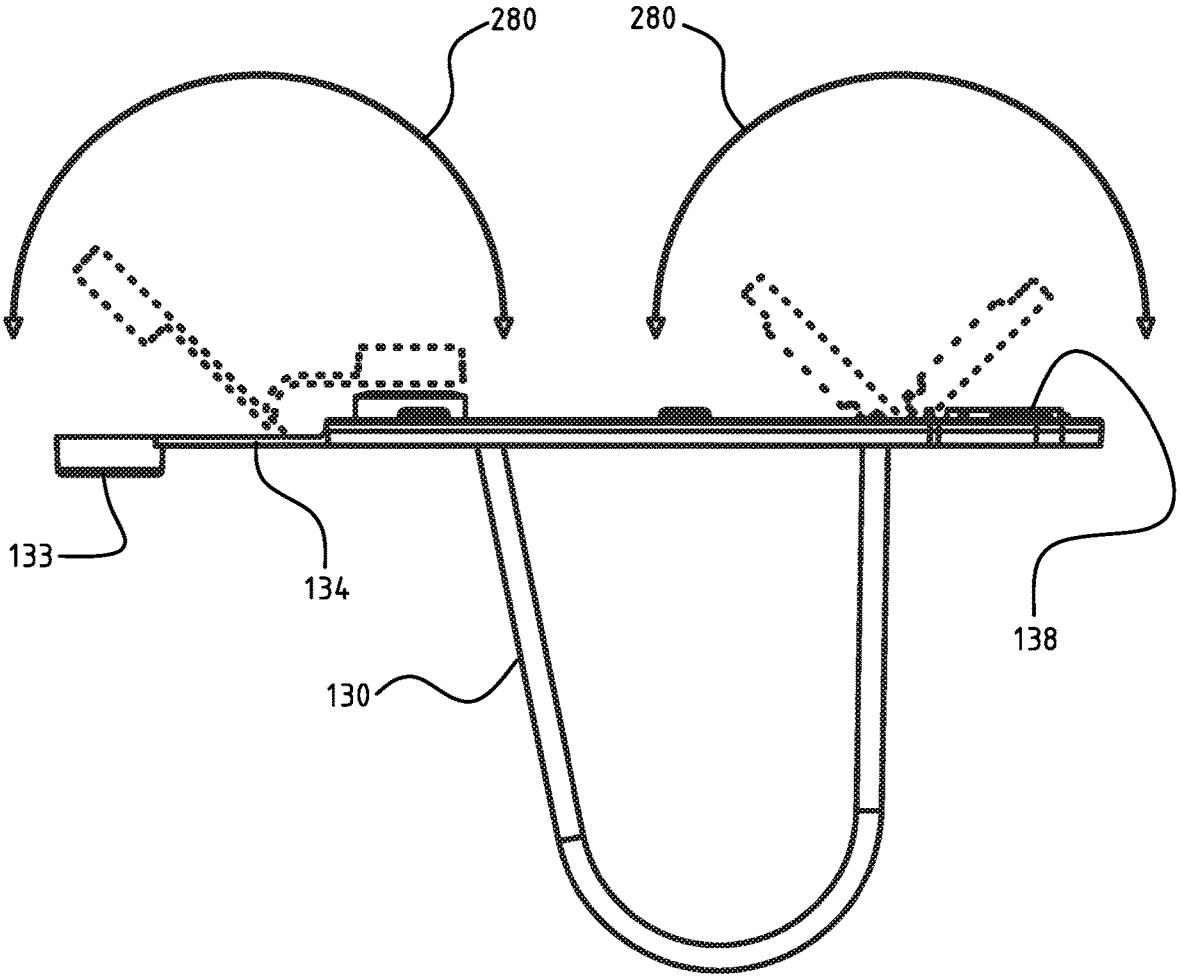
FIG. 22 shows a plan view with the range of motion of a Snap-on Seal Cap of a Disposable Paint Tray, and FIG. 22 also shows the range of motion of a Foldable Section of Disposable Paint Tray.

FIG. 22 shows a plan view of Disposable Paint Tray 130 with the two movable sections of Disposable Paint Tray 130 shown at various orientations. Snap-On Seal Cap 133 shown on the left side of FIG. 22 can move up to and greater than 180-degrees as shown by a Directional Arrow 280 in FIG. 22. Flexible Cap Retainer Strap 134 is a thin, Polypropylene preferred, material, more on this to follow. Foldable Section 138 is shown on the right side of FIG. 22 and can also move up to and greater than 180-degrees as shown by another Directional Arrow 280 in FIG. 22 about a Flexible Hinge 136. Flexible Hinge 136 is a, (living hinge), more on this to follow. Other types of hinges, some much more expensive, could be used on any or all movable sections such as using a flexible cloth attached to two or more separate plastic pieces, or a standard metal hinge as used on doors.

Figure 24:
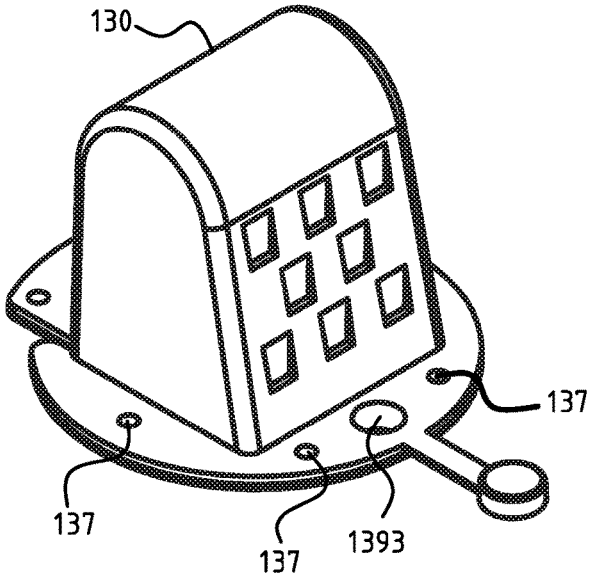
FIG. 24 shows a perspective view with details of underside of Disposable Paint Tray.

FIG. 24 shows a perspective view of Disposable Paint Tray 130 inverted to clearly show some of a plurality of a Locating and Holding Recess 137. Also shown is Hole Clearance for Trough Cap Tube 1393.

Figure 25:
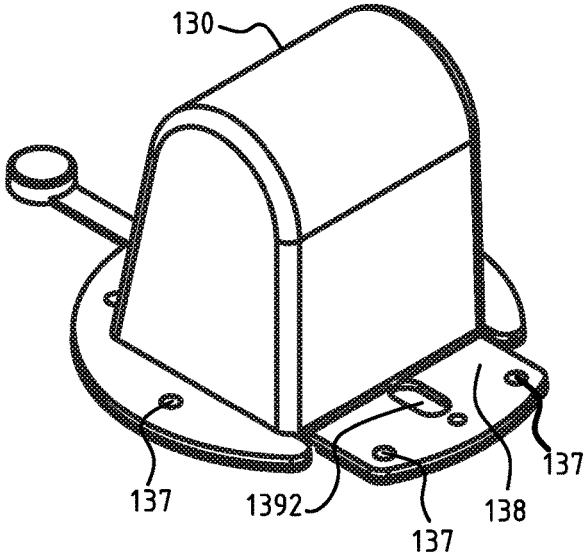
FIG. 25 shows another perspective view with more details of underside of Disposable Paint Tray.

FIG. 25 shows another perspective view of Disposable Paint Tray 130 inverted to clearly show the balance of a plurality of Locating and Holding Recess 137 that are not shown in FIG. 24. Slot Clearance for Rotating Spout 1392 is also shown. In this embodiment there are a total of six Locating and Holding Recess 137 but other quantities, both lower and higher, would also be acceptable.

Figure 26:
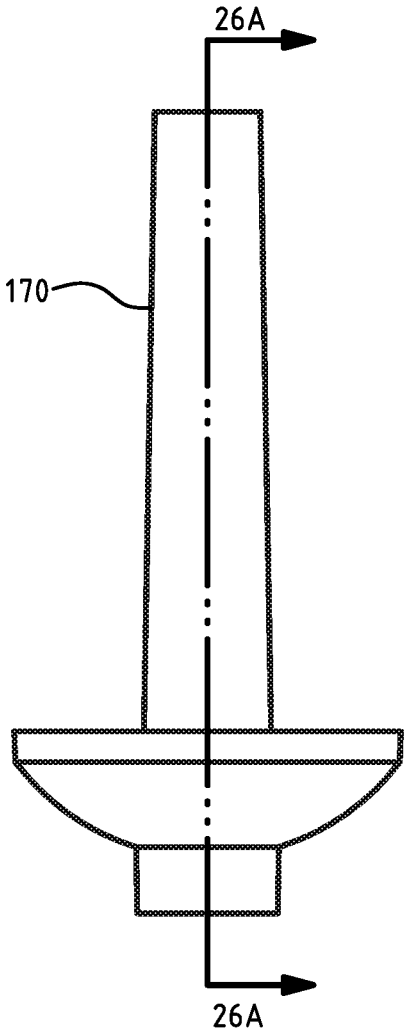
FIG. 26 shows a plan view of a Disposable Siphon Tube.

FIG. 26 shows a plan view of Disposable Siphon Tube 170.

Figure 26A:
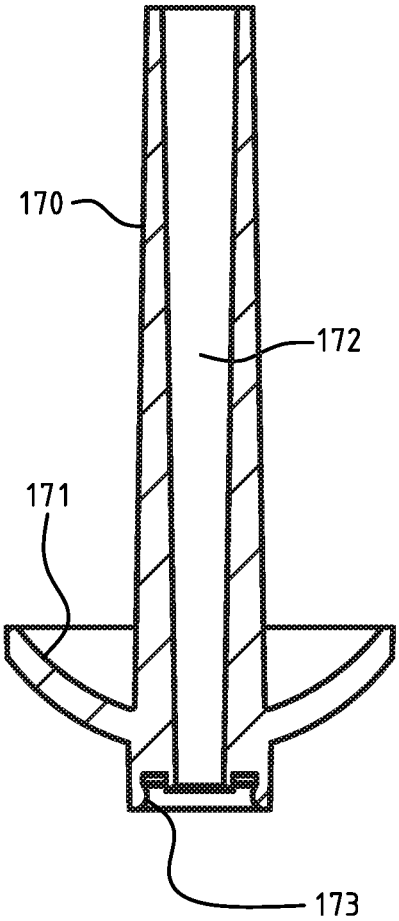
FIG. 26A shows a cross section of FIG. 26 Disposable Siphon Tube with details of features.

FIG. 26A shows a cross section of plan view in FIG. 26. Also shown are Diametrical Inner Edge Female Seal 173, Disposable Siphon Tube Vent 172, and a Paint Catching Recess 171.

Figure 27:
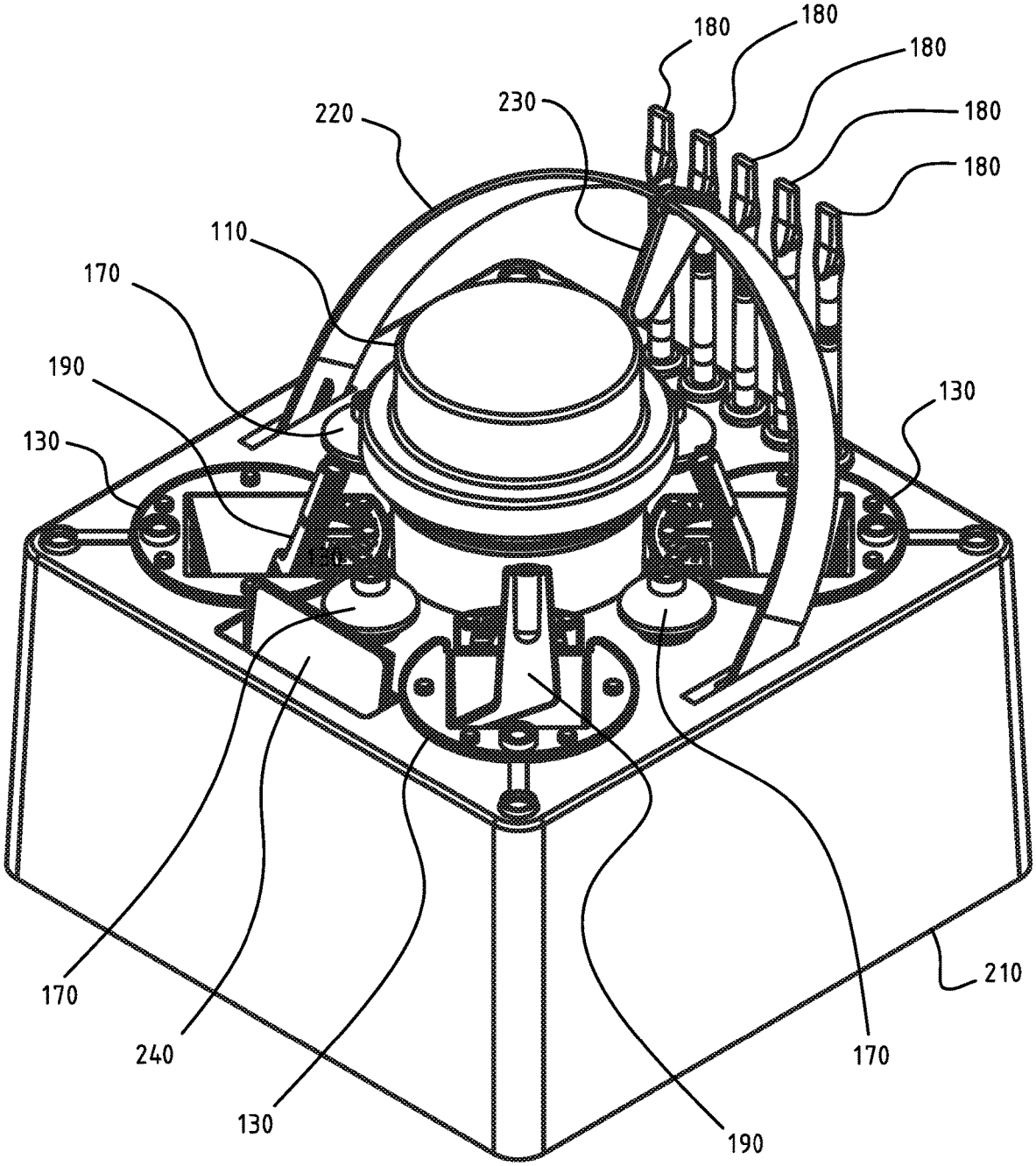
FIG. 27 shows a perspective view of an alternative embodiment of a Touch-Up Paint Kit.

FIG. 27 shows a perspective view of an alternative embodiment of a Paint Touch-up Kit Assembly with a Carrying Tray 210, that can be made of any rigid material, including but not limited to metal, and plastic. Also shown is a Rotatable Carrying Strap 220 which can be made of any flexible material including but not limited to plastic, metal, or heavy cloth such as canvas. In this embodiment Rotatable Carrying Strap 220 is removably attached to Carrying Tray 210 by use of a flexible material for the Rotatable Carrying Strap 220 and simple holes at each end of Rotatable Carrying Strap 220 that are removably snapped over mating diametrical bosses on Carrying Case 210, not shown. Other methods of attaching Rotatable Carrying Strap 220 to Carrying Tray 210 include but are not limited to, sewing, or gluing Strap 220 in place. Also shown is a Strap Lock 230 which can be made from almost any rigid material and is movably connected to Rotatable Carrying Strap 220 along its length by a Strap Lock Slot 231, that is a feature of Strap Lock 230 in this embodiment, that fits over Rotatable Carrying Strap 220. FIG. 27 also includes additional disposable accessories, including a plurality of a Peel and Stick Label 240.

Figure 28:
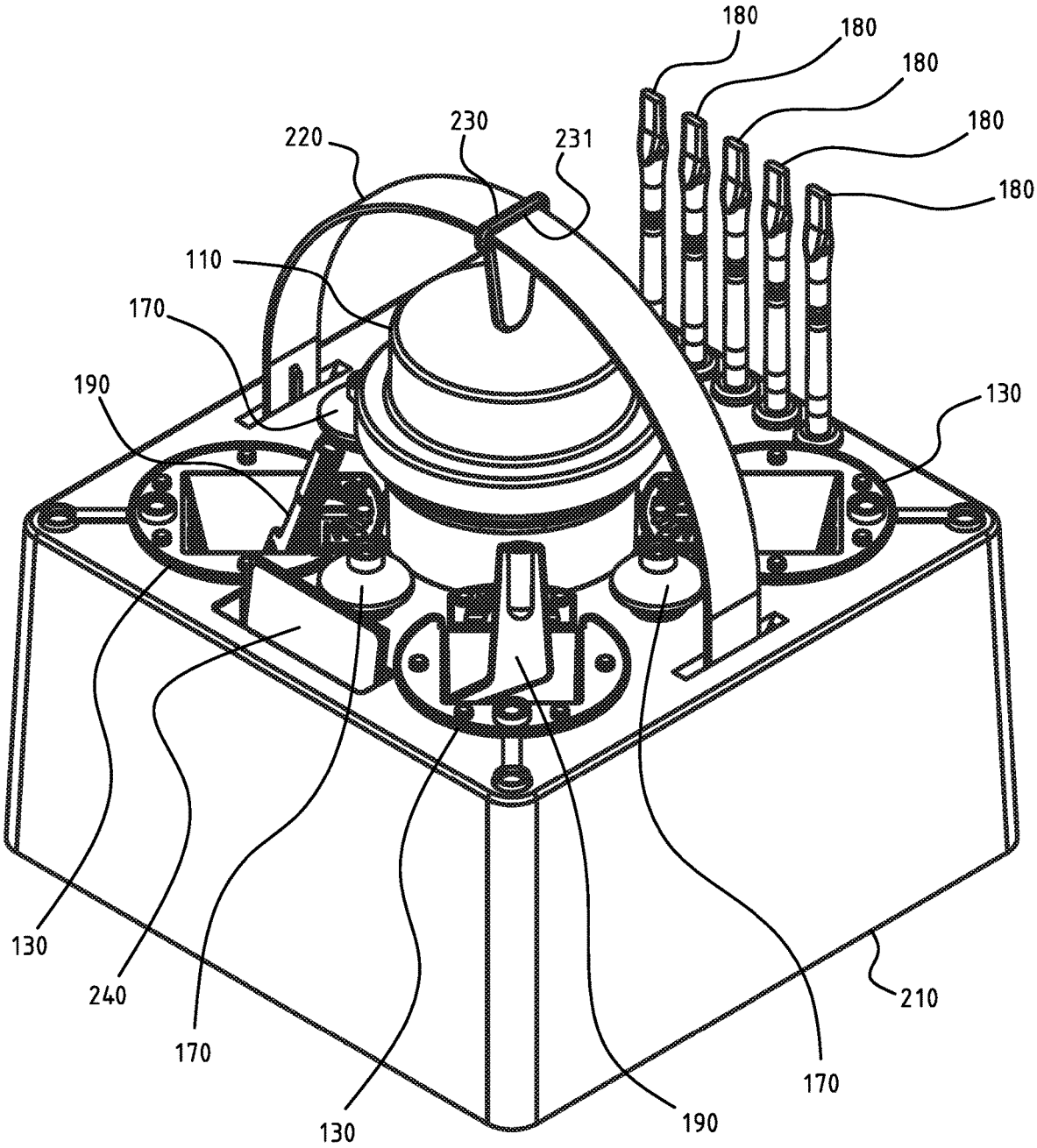
FIG. 28 shows another perspective view of what is shown in FIG. 27.

FIG. 28 shows another perspective view of what is shown in FIG. 27, more on this to follow.

Figure 29:
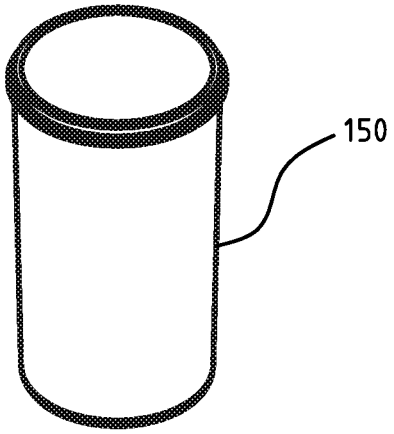
FIG. 29 shows a perspective view of a Cup.

FIG. 29 shows a perspective view of an embodiment of Cup 150.

Figure 32:
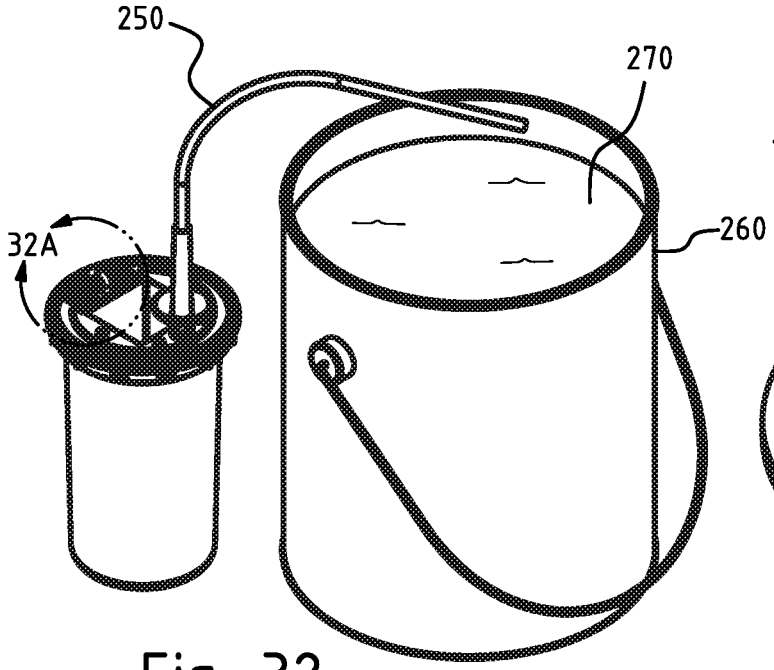
FIG. 32 shows a perspective view of Touch-Up Paint Kit with an added suction tube and an open paint Can.

FIG. 32 shows a perspective view of a Disposable Flexible Suction Tube 250 removably attached to Touch-Up Paint Kit 100 at top open end of its Disposable Siphon Tube 170, in this embodiment the outside diameter of proximal end of Disposable Flexible Suction Tube 250 is press fit into opening at top of Disposable Siphon Tube 170, this removable attachment can also be created by other methods, including but not limited to male and female threads, or clamps. Disposable Flexible Suction Tube 250 can be made of any flexible, chemical resistant material, PVC, and Rubber are preferable. In this embodiment Second Aperture 320 is created by Trough Cap Tube Vent 143, Disposable Siphon Tube Vent 172, and a Disposable Flexible Suction Tube Vent 251, (shown in FIG. 34B). Also shown is a Paint Can 260 containing a Paint 270.

Figure 32A:
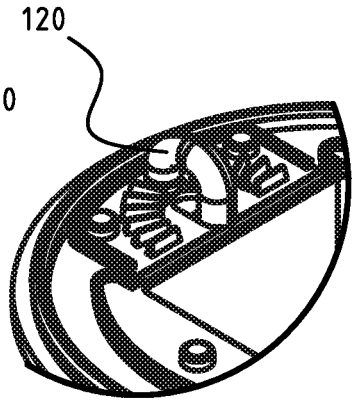
FIG. 32A is a detail of FIG. 32 showing an aperture closed by a Rotatable Pour Spout.

FIG. 32A shows a detail of FIG. 32 whereby Rotatable Pour Spout 120 is shown sealing off First Aperture 310 to Cup Interior 153, more to follow.

Figure 33:
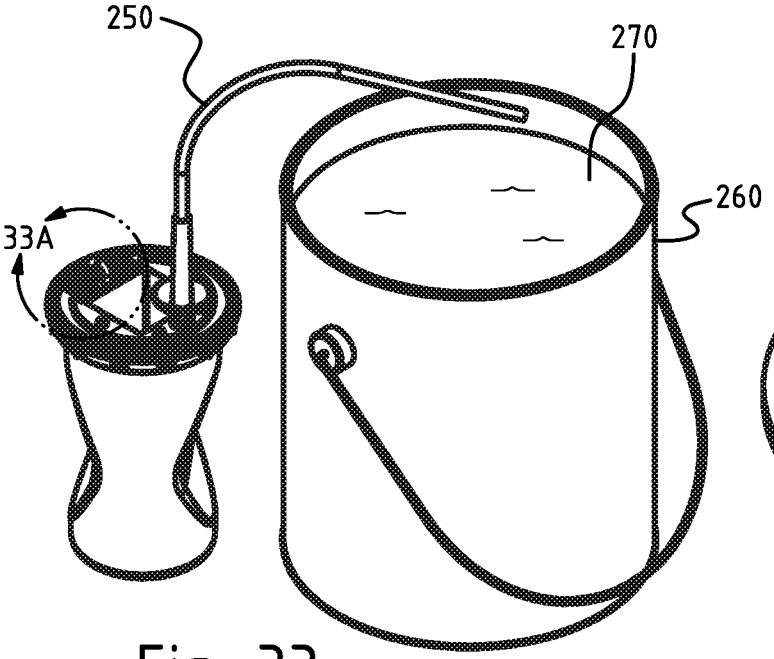
FIG. 33 shows another perspective view of Touch-Up Paint Kit with an added suction tube, an open paint can, and cup squeezed in preparation to receive paint into a storage area.

FIG. 33 shows a perspective view of Disposable Flexible Suction Tube 250 removably attached to Touch-Up Paint Kit 100 at top open end of its Disposable Siphon Tube 170. Also shown is Paint Can 260 containing Paint 270.

Figure 33A:
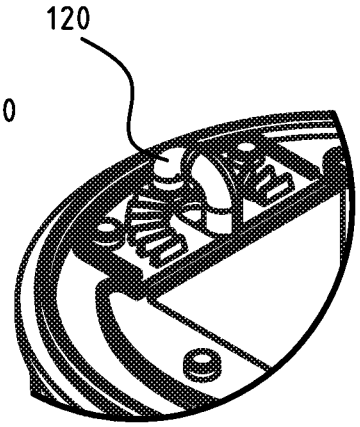
FIG. 33A is a detail of FIG. 33 showing an aperture closed by a Rotatable Pour Spout.

FIG. 33A shows a detail of FIG. 33 whereby Rotatable Pour Spout 120 is shown sealing off First Aperture 310 to Cup Interior 153, more to follow.

Figure 34:
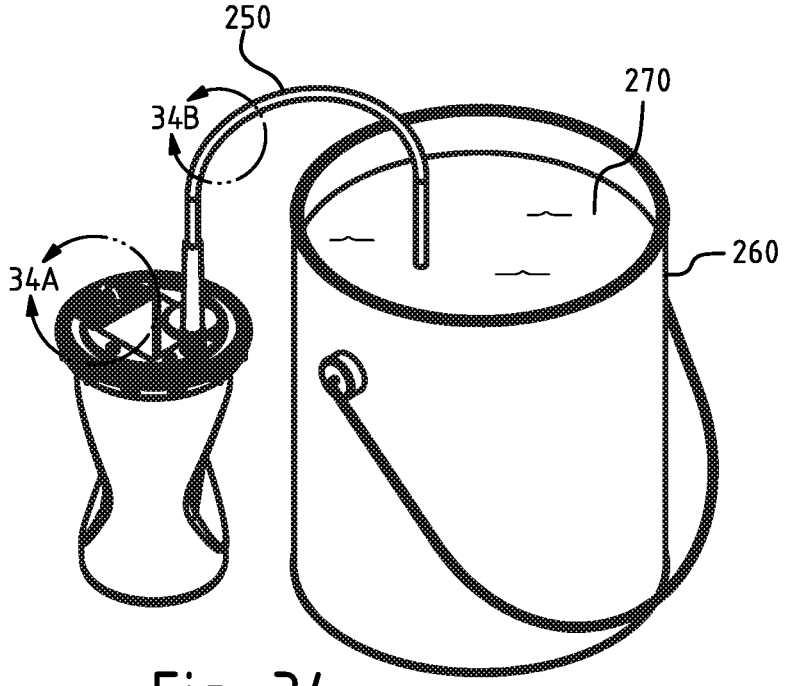
FIG. 34 shows another perspective view of a Touch-Up Paint Kit with an added suction tube placed in an open paint can with cup squeezed in preparation to receive paint.

FIG. 34 shows a perspective view of Disposable Flexible Suction Tube 250 removably attached to Touch-Up Paint Kit 100 at top open end of its Disposable Siphon Tube 170. Also shown is Paint Can 260 containing Paint 270.

Figure 34B:
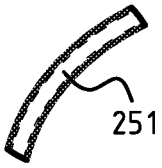
FIG. 34B is another detail of FIG. 34 showing a vent inside of a suction tube.
Figure 34A:
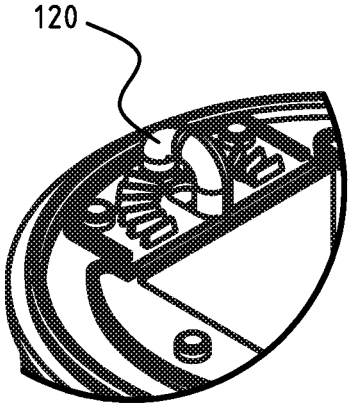
FIG. 34A is a detail of FIG. 34 showing an aperture closed by a Rotatable Pour Spout.

FIG. 34A shows a detail of FIG. 34 whereby Rotatable Pour Spout 120 is shown sealing off First Aperture 310 to Cup Interior 153, more to follow.

FIG. 34B shows a detail of FIG. 34 with hidden lines shown, exposing Disposable Flexible Suction Tube Vent 251.

Figure 35:
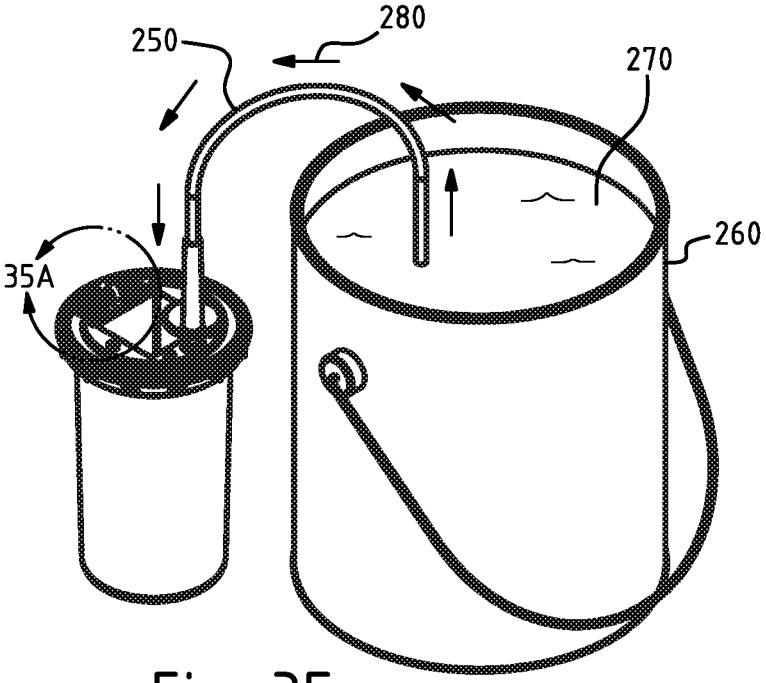
FIG. 35 shows another perspective view of Touch-Up Paint Kit with an added suction tube placed in open paint can with cup un-squeezed to start receiving paint through an open aperture.

FIG. 35 shows a perspective view of Disposable Flexible Suction Tube 250 removably attached to Touch-Up Paint Kit 100 at top open end of its Disposable Siphon Tube 170. Also shown is Paint Can 260 containing Paint 270.

Figure 35A:
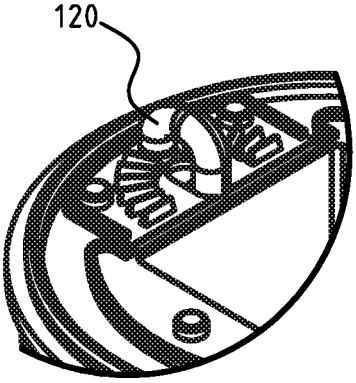
FIG. 35A is a detail of FIG. 35 showing an aperture closed by a Rotatable Pour Spout.

FIG. 35A shows a detail of FIG. 35 whereby Rotatable Pour Spout 120 is shown sealing off First Aperture 310 to Cup Interior 153, more to follow.

Figure 36:
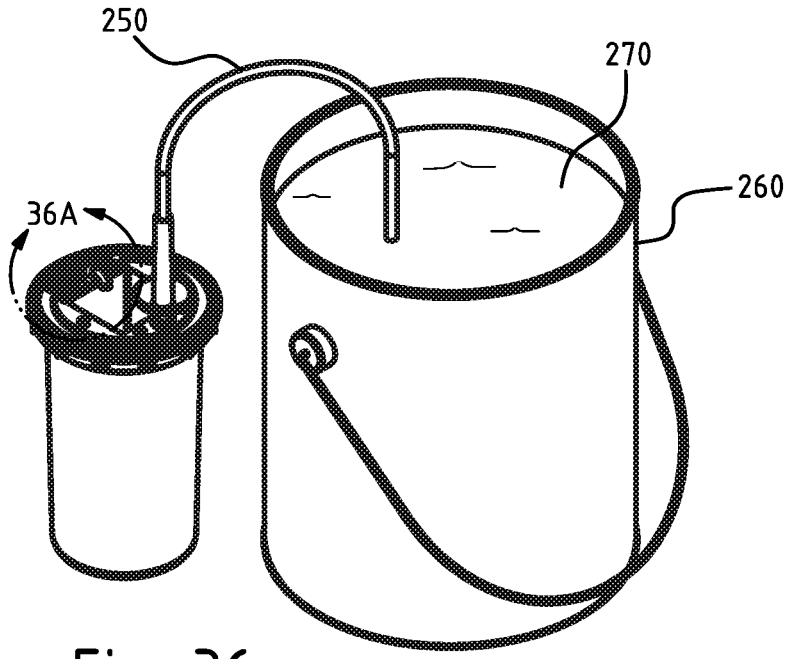
FIG. 36 shows another perspective view of Touch-Up Paint Kit with paint flowing into a storage area due to suction created in suction tube by un-squeezing of cup and opening of another aperture.

FIG. 36 shows a perspective view of Disposable Flexible Suction Tube 250 removably attached to Touch-Up Paint Kit 100 at top open end of its Disposable Siphon Tube 170. Also shown is Paint Can 260 containing Paint 270.

Figure 36A:
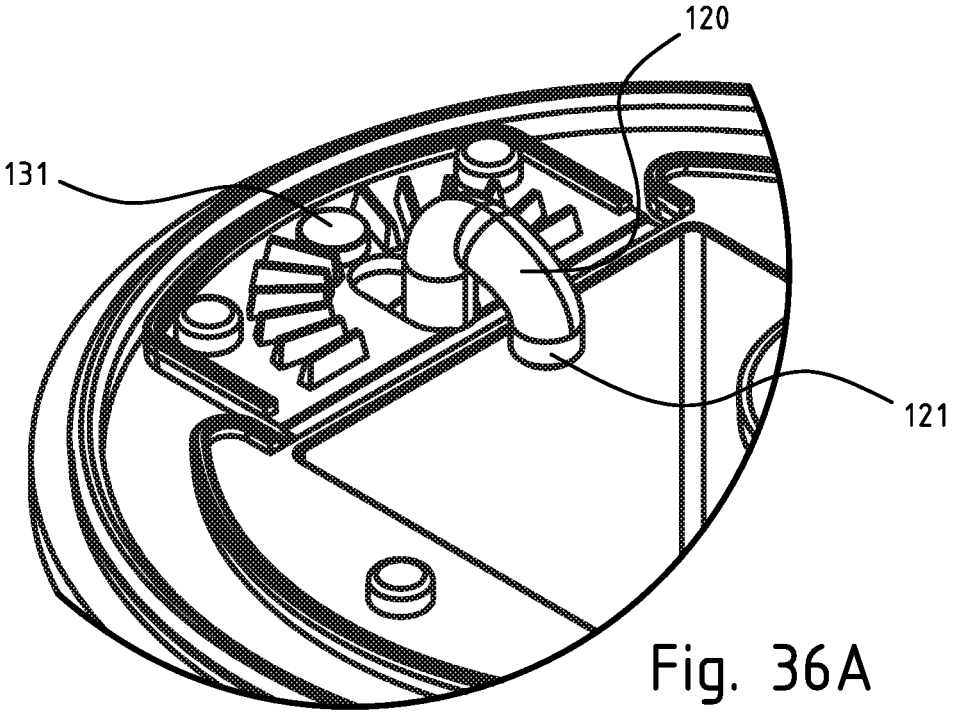
FIG. 36A is a detail of FIG. 36 showing an aperture opened by rotating a Rotatable Pour Spout.

FIG. 36A shows a detail of FIG. 36 whereby Rotatable Pour Spout 120 is shown not sealing off First Aperture 310 to Cup Interior 153, more to follow.

FIG. 37A shows a perspective view of an additional embodiment of a Cup 150B in a stretched position which creates additional volume in Cup Interior 153.

FIG. 37B shows a perspective view of Cup 150B in a natural, (no preload), as fabricated, or as manufactured position, or shape which shows the volume of Cup Interior 153 when not being compressed or extended by user.

FIG. 37C shows a perspective view of an additional embodiment of Cup 150B in a compressed position which creates less volume in Cup Interior 153.

FIG. 38A shows a perspective view of an additional embodiment of Cup 150, labeled in this FIG. 38A as a Cup 150C to avoid confusion between additional embodiments. Cup 150C is shown in an extended position which creates additional volume in Cup Interior 153. In this embodiment Cup 150C is made of two separate parts, a Cup Top 154 which material can be a Rigid Clear Plastic, one example being Polycarbonate but other clear rigid materials such as glass could also be used. The other part being a Cup Bottom 155, which could be made of materials same as Cup Top 154. Cup Top 154 has an inside diameter that matches the outside diameter of Cup Bottom 155 allowing for these two parts to slide along each other's longitudinal axes while maintaining a substantially airtight seal between them, more to follow.

FIG. 38B shows a perspective view of Cup 150C in a central position which shows the volume of Cup Interior 153 when not being compressed or extended by user, in a nominal position relative to its two component parts, more to follow.

FIG. 38C shows a perspective view of Cup 150C in a more compressed position which creates less volume in Cup Interior 153, more to follow.

FIG. 39A shows a perspective view of an additional embodiment of Cup 150, labeled in this FIG. 39A as a Cup 150D to avoid confusion between additional embodiments. Cup 150D is in an extended position which creates additional volume in Cup Interior 153. In this embodiment Cup 150D is made of two separate parts, a Cup Top Female Threaded 156 which material can be a Rigid Clear Plastic, one example being Polycarbonate but other clear rigid materials such as glass could also be used. The other part being a Cup Bottom Male Threaded 157 which could be made of materials same as Cup Top Female Threaded 156. Cup Top Female Threaded 156 has one cross section, (perpendicular to its longitudinal axis), of its inside diameter that matches the outside diameter of one cross section of Cup Bottom Male Threaded 157, allowing for these two parts to move along each other's longitudinal axes while maintaining a substantially airtight seal between them. These two parts also have male and female threads that allow for these two parts to helically revolve about each other along their longitudinal axes thereby increasing or decreasing the volume in Cup Interior 153, in this embodiment the volume of Cup Interior 153 is increased by rotating Cup Top Female Threaded 156 and Cup Bottom Male Threaded 157 away from each other, more to follow.

FIG. 39B shows a perspective view of Cup 150D in a central position which shows the volume of Cup Interior 153 when not being fully extended or fully compressed, more to follow.

FIG. 39C shows a perspective view of an additional embodiment of Cup 150D in a more compressed position which creates less volume in Cup Interior 153, more to follow.

FIG. 40 shows a plan view of Top Cap 110.

FIG. 40A shows a cross section of FIG. 40 where we can see an alternative embodiment of Top Cap 110 with a Moisture Distributor 290 located on underside of Top Cap 110. Moisture Distributor 290 can be fixed in place with an interference fit between its outside shape and the inside shape of Top Cap 110, or by gluing, heat sealing or some other adhering method. Moisture Distributor 290 can be a synthetic or natural sponge or some other moisture absorbent material.

FIG. 41 shows a plan view of Disposable Paint Brush 180 removably inserted into Disposable Handle 191 of Disposable Paint Roller Assembly 190 at Extension Pocket 193, (shown in FIG. 17), of Disposable Handle 191. In this present embodiment the removable connection is created by an interference fit between the outer shape of Paint Brush Handle End 181 which is pushed into Extension Pocket 193, but other removably attachable connections, including but not limited to, a snap fit, male and female threads, are also acceptable methods of removable attachment.

FIG. 42 shows a plan view of Touch-up Paint Kit 100 with Disposable Siphon Tube 170 snapped onto Trough Cap Tube 141, FIG. 42 also partially shows Disposable Flexible Suction Tube 250 attached to Disposable Siphon Tube 170, more to follow.

FIG. 42A is a cross section of FIG. 42 showing an alternative embodiment of Touch-up Paint Kit 100 with a Floating Seal 330 installed. Floating Seal 330 is a simple mechanism that is widely known and commercially available and as such there is no need to describe it in detail.

FIG. 42B is a detail of cross section FIG. 42A showing Floating Seal 330.

Operation—FIG. 7 through FIG. 23, FIG. 40, and FIG. 41

FIG. 7 shows a step for installing or replacing Disposable Paint Tray 130 into Trough Cap 140. All pluralities of Locating and Holding Boss 147 of Trough Cap 140 are shown, and their locations are spaced such that they create planar stresses with the mating pluralities of Locating and Holding Recess 137, (shown in FIG. 8), of Disposable Paint Tray 130. The plurality of Locating and Holding Boss 147 are placed outwardly of Touch-Up Paint Kit 100 center relative to the placement of the plurality of Locating and Holding Recess 137 such that Disposable Paint Tray 130 is stretched outwardly thus creating a removable attachment between Trough Cap 140 and Disposable Paint Tray 130. This stress is significant as Touch-Up Paint Kit 100 may be inverted up to, and greater than 180-degrees in some embodiments during its use and Disposable Paint Tray 130 needs to remain attached during this inversion.

FIG. 8 shows another step for installing or replacing Disposable Paint Tray 130 into Trough Cap 140. Disposable Paint Tray 130 is shown with Foldable Section 138, rotated up to, or greater than 180-degrees about Flexible Hinge 136, and Rotatable Pour Spout 120 being rotated away from the center of Cup 150, and Hole Clearance for Trough Cap Tube 1393, (shown in FIG. 24), passing over and around Trough Cap Tube 141 allowing Disposable Paint Tray 130 to be dropped down into Trough Cap Pocket 1491, (shown in FIG. 7). Four of the pluralities of Locating and Holding Recess 137 are removably pressed onto the four mating pluralities of Locating and Holding Boss 147. The two other pluralities of Locating and Holding Recess 137 are shown not pressed onto Locating and Holding Boss 147, as Foldable Section 138 is shown in the folded, not as manufactured, orientation in this embodiment. Snap-On Seal Cap 133 is shown not removably snapped on to Trough Cap Tube 141. In this embodiment Second Aperture 320 is open and is created by Trough Cap Tube Vent 143 which is open and exposing Cup Interior 153 to external atmosphere. In this embodiment there are a total of six Locating and Holding Recess 137 shown, a quantity of two Locating and Holding Recess 137 are located on Foldable Section 138 of Disposable Paint Tray 130 and the remaining Locating and Holding Recess 137 are on Disposable Paint Tray 130 that is not part of Foldable Section 138, but other quantities, both lower and higher, of Locating and Holding Recess 137 can be on Foldable Section 138 of Disposable Paint Tray 130, and other quantitieS, both lower and higher, of Locating and Holding Recess 137 can also be on the Disposable Paint Tray 130 that is not part of Foldable Section 138. In this embodiment Disposable Paint Tray 130 is removably attached to Trough Cap 140 by a plurality of recesses and bosses, but there are other methods of removably attaching Disposable Paint Tray 130 to Trough Cap 140 including, but not limited to, snap fits, and use of screws to hold in place, but the method described in this embodiment is cost effective as no secondary hardware is required for removable attachment of Disposable Paint Tray 130 and Trough Cap 140. FIG. 8 also shows Flexible Cap Retainer Strap 134 which is a movable and rotatable aspect of Disposable Paint Tray 130. Flexible Cap Retainer Strap 134 connects Snap-On Seal Cap 133 to the main body of Disposable Paint Tray 130 thus allowing for Snap-On Seal Cap 133 to be removably attached to, and removed from, Trough Cap Tube 141 indefinitely. This removable attachment of Snap-On Seal Cap allows user to open and close Second Aperture 320 as needed to do the various paint moving methods described in other parts of this disclosed subject matter. Snap-On Seal Cap 133 also allows Disposable Paint Tray 130 to serve multiple functions with fewer components, for example, no additional hinge hardware is required, lowering fabrication and assembly costs. This also makes some embodiments easier to use as Snap-On Seal Cap 133 cannot be easily lost as it is tethered to Disposable Paint Tray 130 via Flexible Cap Retainer Strap 134. This one-piece design of Disposable Paint Tray 130 is efficient and cost effective but that in no way limits how this movable and rotatable feature of Snap-On Seal Cap 133 is fabricated, and secondary hardware such as hinges, or a glued-on cloth connector could also be used.

FIG. 9 shows another step for installing or replacing Disposable Paint Tray 130 into Trough Cap 140. Rotatable Pour Spout 120 is shown rotated towards center of Cup 150 and located centered over Slot Clearance for Rotating Spout 1392 of Disposable Paint Tray 130. Foldable Section 138 is still in the folded position. Snap-On Seal Cap 133 is still shown not removably snapped on to Trough Cap Tube 141. In this embodiment Second Aperture 320 is still created by Trough Cap Tube Vent 143 which is open and exposing Cup Interior 153 to external atmosphere.

FIG. 10 shows another step for installing Disposable Paint Tray 130 into Trough Cap 140. Foldable Section 138 is shown unfolded, with the two remaining Locating and Holding Boss 147 removably pressed into the two remaining Locating and Holding Recess 137 of Disposable Paint Tray 130 to hold down Foldable Section 138. Rotatable Pour Spout is still shown rotated towards center of Cup 150. Snap-On Seal Cap 133 is still shown not removably snapped on to Trough Cap Tube 141. In this embodiment Second Aperture 320 is still created by Trough Cap Tube Vent 143 which is open and exposing Cup Interior 153 to external atmosphere.

FIG. 11 shows a step for putting wet paint into Cup 150 from an external source, such as an open can of paint or from a paint tray with paint in it. Rotatable Pour Spout 120 is shown rotated outward and away from center of Cup 150 and seated on Spherical Seal Boss 131 creating a substantially air tight seal of Cup Interior 153 at First Aperture 310. Snap-On Seal Cap 133 is shown not removably snapped on to Trough Cap Tube 141. In this embodiment Second Aperture 320 is still created by Trough Cap Tube Vent 143 which is open and exposing Cup Interior 153 to external atmosphere.

FIG. 12 shows another step for putting wet paint into Cup 150 from an external source, such as an open can of paint or from a paint tray with paint in it. Rotatable Pour Spout 120 is again shown rotated outward and away from center of Cup 150 and seated on Spherical Seal Boss 131 maintaining a substantially air tight seal of Cup Interior 153. Disposable Siphon Tube 170 is shown removably attached to Trough Cap Tube 141 at its Trough Cap Tube Diametrical Outer Edge Male Seal 146. In this embodiment Second Aperture 320 is created through Trough Cap Tube Vent 143 and through Disposable Siphon Tube Vent 172 to expose Cup Interior 153 to the external atmosphere. More on the description of bringing wet paint into Cup Interior 153 to follow.

FIG. 13 shows a step to substantially air tight seal Cup Interior 153 from external environment, (external atmosphere). This is a sealing method used when storing wet paint that is in Cup Interior 153 when paint has already been vented into Paint Tray Pocket 1391 and user will be doing touch-up painting while keeping wet paint stored in Cup Interior 153 substantially sealed off from external atmosphere, or external environment. Disposable Siphon Tube 170 has been removed from Trough Cap Tube 141, and Snap-On Seal Cap 133 has been removably attached to Trough Cap Tube 141 at its Trough Cap Tube Diametrical Outer Edge Male Seal 146, sealing Second Aperture 320. Rotatable Pour Spout 120 is again shown rotated outward and away from center of Cup 150 and seated on Spherical Seal Boss 131 sealing First Aperture 310.

FIG. 14 shows a step to vent wet paint from Cup Interior 153 of Cup 150 into Paint Tray Pocket 1391 of Disposable Paint Tray 130. Snap-On Seal Cap 133 has been removably attached to Trough Cap Tube 141 at its Trough Cap Tube Diametrical Outer Edge Male Seal 146 thus sealing Second Aperture 320. Rotatable Pour Spout 120 is rotated towards center of Cup 150 and over Paint Tray Pocket 1391 thus opening First Aperture 310. User will squeeze Cup 150 and wet paint will travel from Cup Interior 153, through Flexible Tube Vent 127, then through Rigid Tube Vent 126, then through Pour Spout Vent 125 and out into Paint Tray Pocket 1391. additional description of this to follow.

FIG. 15 shows a step where the user uses Disposable Paint Brush 180 to get wet paint from Paint Tray Pocket 1391 to do touch-up painting. Snap-On Seal Cap 133 has been removably attached to Trough Cap Tube 141 at its Trough Cap Tube Diametrical Outer Edge Male Seal 146, sealing Second Aperture 320. Rotatable Pour Spout 120 is again shown rotated outward and away from center of Cup 150 and seated on Spherical Seal Boss 131 sealing First Aperture 310. By having both First Aperture 310 and Second Aperture 320 in the substantially air tight sealed positions, the user can do touch-up painting using paint from Paint Tray Pocket 1391 while simultaneously storing wet paint safely and securely, cannot leak, in Cup Interior 153. FIG. 15 also shows a plurality of Scraping Blade 132, (shown in FIG. 10), on both sides of Spherical Seal Boss 131, after Paint Tray Pocket 1391 has had wet paint placed into it, as previously described, then to seal the wet paint stored in Cup Interior 153 the user rotates Rotatable Pour Spout 120 from its previous position over Paint Tray Pocket 1391 to its seat on Spherical Seal Boss 131 and while doing this turning the Replaceable Pour Spout Tip 121 is scraped over these pluralities of Scraping Blade 132 thus eliminating excess paint, to allow for indefinite re-use of this embodiment. FIG. 15 also shows a plurality of Paint Retaining Wall 139 which substantially contains paint onto Disposable Paint Tray 130 during use doing touch-up painting thereby extending the use of disclosed subject matter indefinitely. FIG. 15 also shows Paint Brush Handle End 181 which removably fits into Extension Pocket 193 of Disposable Handle 191, (shown in FIG. 16), removably holding Disposable Paint Brush 180 to Disposable Handle 191 with an interference fit. Note that other connecting methods could be used, such as, but not limited to a snap fit, or male and female threads.

FIG. 16 shows a step where the user uses Disposable Paint Roller Assembly 190 to get wet paint from Paint Tray Pocket 1391 to do touch-up painting. Snap-On Seal Cap 133 has been removably attached to Trough Cap Tube 141 at its Trough Cap Tube Diametrical Outer Edge Male Seal 146, sealing Second Aperture 320. Rotatable Pour Spout 120 is again shown rotated outward and away from center of Cup 150 and seated on Spherical Seal Boss 131 sealing First Aperture 310. Paint Roller Excess Paint Removal Surface 1394, (shown in FIG. 8), which has a plurality of Excess Paint Removal Boss 1395, (also shown in FIG. 8), can be used to facilitate the removal of excess paint from Disposable Paint Roller Assembly 190 when user rolls Disposable Paint Roller 192 of Assembly 190 on Paint Roller Excess Paint Removal Surface 1394, this eliminates the need for post touch-up painting clean up.

FIG. 17 shows a step where the user will prepare to store Touch-Up Paint Kit 100 with a used Disposable Paint Roller 192, and with wet paint at the bottom of Paint Tray Pocket 1391 after doing touch-up painting as it may not be necessary to replace Disposable Paint Tray 130 after every use. Disposable Paint Roller Assembly 190 is shown fully dropped down into bottom of Paint Tray Pocket 1391. Snap-On Seal Cap 133 has been removably attached to Trough Cap Tube 141 at its Trough Cap Tube Diametrical Outer Edge Male Seal 146, substantially air tight sealing Second Aperture 320. Rotatable Pour Spout 120 is again shown rotated outward and away from center of Cup 150 and seated on Spherical Seal Boss 131 thus substantially air tight sealing First Aperture 310.

FIG. 18 is a plan view of Touch-Up Paint Kit 100 in preparation for cross section 19A to follow.

FIG. 19A shows a Cross Section of FIG. 18 plan view. This embodiment includes the stored Disposable Paint Roller Assembly 190. Disposable Handle 191 of Disposable Paint Roller Assembly 190 fits inside of Top Cap 110 when Top Cap 110 is snapped onto Trough Cap 140 thus creating a substantially air tight sealed environment allowing for wet paint to remain in Paint Tray Pocket 1391 and on Disposable Paint Roller 192 for indefinite storage and later reuse of same wet paint. In this embodiment, Snap-On Seal Cap 133 has been removably attached to Trough Cap Tube 141 at its Trough Cap Tube Diametrical Outer Edge Male Seal 146, substantially air tight sealing Second Aperture 320. In this embodiment Rotatable Pour Spout 120 is shown rotated outward and away from center of Cup 150 and seated on Spherical Seal Boss 131 substantially air tight sealing First Aperture 310. In another embodiment either or both apertures, First Aperture 310, or Second Aperture 320 could be left open and Touch-Up Paint Kit 100 would still not leak if knocked over because of Top Cap 110 being snapped onto Trough Cap 140. This embodiment with open apertures and a substantially air tight seal caused by Top Cap 110 being snapped onto Trough Cap 140 allows moisture from Moisture Distributor 290, (shown in FIG. 40A), to moisturize any air in Cup Interior 153 thus indefinitely extending the useful life of paint stored in Cup Interior 153. FIG. 19A also shows Trough Cap 140 removably attached to Cup 150 by Threaded Male Aspect 142 of Trough Cap 140, (shown in FIG. 5A), and Threaded Female Aspect 161 of Threaded Locking Ring 160, (also shown in FIG. 5A), where Threaded Male Aspect 142, and Threaded Female Aspect 161 allow the user to also add wet paint to Cup Interior 153 by unscrewing Threaded Locking Ring 160 from Trough Cap 140 and then removing Trough Cap 140 from top of Cup 150, and then pouring, or using other liquid transfer methods, to add wet paint to Cup Interior 153 and then replacing Trough Cap 140 to top of Cup 150 and screwing Threaded Locking Ring 160 back onto Trough Cap 140.

FIG. 20 is a plan view of Touch-Up Paint Kit 100 that shows a step for bringing paint into Cup Interior 153 from an external source. Rotatable Pour Spout 120 rotated over Spherical Seal Boss 131 creating a substantially air tight seal between Replaceable Pour Spout Tip 121 and Spherical Seal Boss 131 with a substantially air tight sealing of Cup Interior 153 at First Aperture 310. Disposable Siphon Tube 170 is shown attached via Diametrical Inner Edge Female Seal 173 to Trough Cap Tube 141 at Trough Cap Tube Diametrical Outer Edge Male Seal 146, creating Second Aperture 320 from Cup Interior 153, through Trough Cap Tube Vent 143 and through Disposable Siphon Tube Vent 172, out to external atmosphere. Touch-Up Paint Kit 100 is shown inverted with Disposable Siphon tube 170 pointing down, two horizontal Directional Arrow 280 to the left and two other Directional Arrow 280 to the right of Cup 150 show how mechanical pressure, in this embodiment the squeezing of user's hand over two opposing sides of Cup 150, compresses part of Cup 150 and air is expelled from Cup Interior 153 through Second Aperture 320. User then lowers tip of Disposable Siphon Tube 170 down into wet paint stored in Paint Can 260 or paint tray, or other paint holding device or container and releases mechanical pressure exerted on Cup 150 and the shape memory material will return to its natural cup shape and a vacuum will be created in Cup Interior 153 causing wet paint to flow into Second Aperture 320. Disposable Siphon Tube Vent 172 is shown with vertical, upward pointing Directional Arrow 280 in FIG. 20 and into Cup Interior 153. User then reverts Touch-Up Paint Kit 100 to normal vertical position and any wet paint residue left on tip of Disposable Siphon Tube 170 will run down the outside of Disposable Siphon Tube 170 and get captured in Paint Catching Recess 171, which will be shown in following FIG. 26A. In this embodiment a user squeezes and releases Cup 150 by hand to bring paint in for storage, other methods can be used, including but not limited to a motorized device to cause the squeezing and releasing of Cup 150.

FIG. 21 shows a step where wet paint will be moved from Cup Interior 153 to Paint Tray Pocket 1391. Snap-On Seal Cap 133 is removably attached to Trough Cap Tube 141 via Trough Cap Tube Diametrical Outer Edge Male Seal 146, creating a substantially air tight seal to Cup Interior 153 at Second aperture 320. Rotatable Pour Spout 120 is rotated towards center of Cup 150 and over Paint Tray Pocket 1391 thereby opening First Aperture 310. Wet paint is already stored in Cup Interior 153 of Cup 150 as described above. Cup 150 is mechanically squeezed, one method would be squeezing of user's hand over two opposing sides of Cup 150, as shown in this FIG. 21 with two horizontal Directional Arrow 280 at left and two other horizontal Directional Arrow 280 at right of Cup 150, thus increasing pressure in Cup Interior 153 and pushing wet paint up through First Aperture 310 created by Flexible Tube Vent 127, Rigid Tube Vent 126, and Pour Spout Vent 125 and into Paint Tray Pocket 1391 as shown by downward pointing vertical Directional Arrow 280 in FIG. 21. When mechanical pressure is released from Cup 150 the shape memory material will cause Cup 150 to return to its cup shape thus creating a vacuum in Cup Interior 153 pulling any wet paint still in First Aperture 310 back down into Cup Interior 153. The space occupied by wet paint that was taken from Interior Cup 153, will be replaced by air in the external atmosphere that is pulled in through First Aperture 310 as Cup 150 returns to its natural, no preload, cup shape with the larger internal area, Cup Interior 153. In this embodiment a user squeezes Cup 150 by hand to flow paint from Cup Interior 153 into Paint Tray Pocket 1391, other methods can be used, including but not limited to a motorized device to cause the squeezing and releasing of Cup 150.

FIG. 22 shows a plan view of Disposable Paint Tray 130 with the two movable sections of Disposable Paint Tray 130 shown at various orientations. Snap-On Seal Cap 133 shown on the left can move as shown by Directional Arrow 280 in FIG. 22 allowing for the sealing and unsealing of Second Aperture 320. Foldable Section 138 shown on the right side can move as shown by the other Directional Arrow 280 in FIG. 22 about Flexible Hinge 136 this allows for the installation and, or replacement of Disposable Paint Tray 130.

Figure 23:
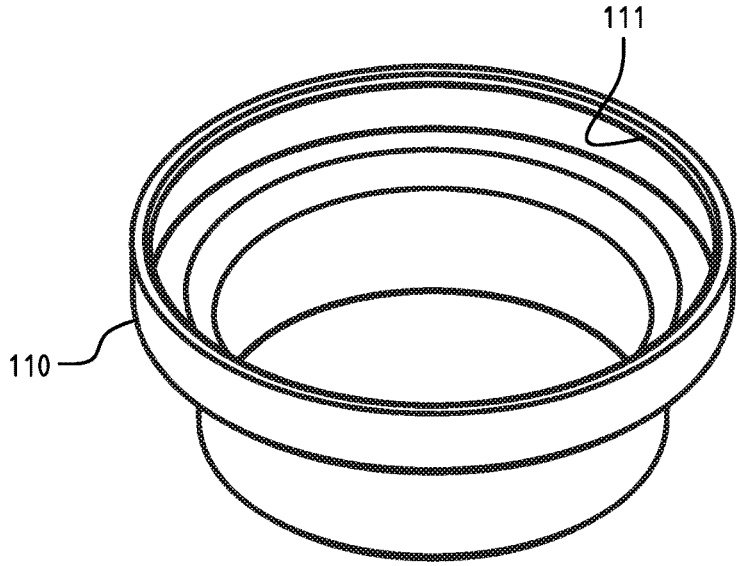
FIG. 23 shows a perspective view of underside of Top Cap with a Diametrical Inner Edge Female Seal clearly shown.

FIG. 23 is a perspective view of Top Cap 110 inverted to clearly show Diametrical Inner Edge Female Seal 111. This Diametrical Inner Edge Female Seal 111 creates a substantially air tight seal between Trough Cap 140 and Top Cap 110 because Diametrical Inner Edge Female Seal 111 of Top Cap 110 has an interference fit with Trough Cap Diametrical Outer Edge Male Seal 145 of Trough Cap 140 so that Top Cap 110 can be removably snapped onto Trough Cap 140, as shown in this embodiment. This snap fit is also shown previously in FIG. 6*a*.

FIG. 40 shows a plan view of Top Cap 110. This view will be referenced by FIG. 40A, to follow.

FIG. 41 shows a plan view of Disposable Paint Brush 180 removably inserted into Disposable Handle 191 of Disposable Paint Roller Assembly 190 at Extension Pocket 193, (shown in FIG. 17), of Disposable Handle 191. By connecting Paint Brush Handle End 181 to Extension Pocket 193 of Disposable Handle 191 the user has the added benefit of extending their reach for touch-up painting, thus when using Disposable Paint Brush 180 for touch-up painting the user can hold Disposable Handle 191 of Disposable Paint Roller Assembly 190 to extend the user's reach for touch-up painting with this extended Disposable Paint Brush 180, and when using Disposable Paint Roller Assembly 190 to do painting with Disposable Paint Roller 192 the user can hold Disposable Paint Brush 180 to extend the user's reach for touch-up painting with this extended Disposable Paint Roller Assembly 190.

FIG. 30, FIG. 31, and FIG. 37A through FIG. 39C—Additional Embodiments of Cup 150

Figure 30:
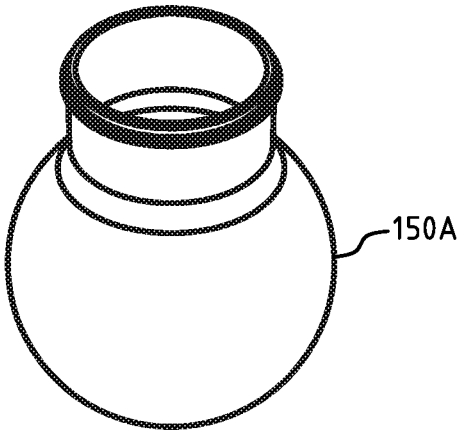
FIG. 30 shows a perspective view of an additional embodiment of a Cup.

FIG. 30 shows a perspective view of an additional embodiment of Cup 150, labeled in this FIG. 30 as a Cup 150A to avoid confusion between Cup 150 and additional embodiment Cup 150A. Cup 150A can be made of the same materials and with the same transparencies as those used for Cup 150. This additional embodiment shows that the shape of Cup 150 can be altered in many ways and still function effectively in this described subject matter.

Figure 31:
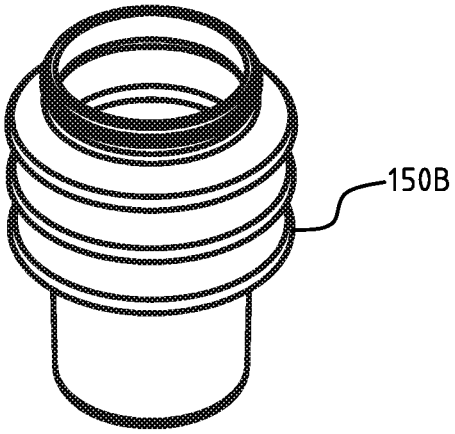
FIG. 31 shows a perspective view of another additional embodiment of a Cup.

FIG. 31 shows a perspective view of an additional embodiment of Cup 150, labeled in this FIG. 31 as Cup 150B to avoid confusion between Cup 150 and additional embodiment Cup 150B. Cup 150B can be made of the same materials and with the same transparencies as those used for Cup 150. This additional embodiment also shows that the shape of Cup 150 can be altered in many ways and still function effectively in this described subject matter.

FIG. 37A again shows a perspective view of the additional embodiment of Cup 150, labeled in this FIG. 37A as Cup 150B. Cup 150B is shown in a stretched position which creates additional volume in Cup Interior 153. This extension will allow for the intake of additional paint into Cup Interior 153 as described earlier, with less effort, and in less time.

FIG. 37B again shows a perspective view of the additional embodiment of Cup 150, labeled in this FIG. 37B as Cup 150B, and shown in a natural, as fabricated, or as manufactured position, or shape which shows the volume of Cup Interior 153 when not being compressed or extended by user. With volume of Cup Interior 153 being less than in additional embodiment shown in FIG. 37A, but with volume being greater than in additional embodiment to be shown in FIG. 37C.

FIG. 37C again shows a perspective view of the additional embodiment of Cup 150, labeled in this FIG. 37C as Cup 150B, and shown in a compressed position which creates less volume in Cup Interior 153. This compression will allow for the expulsion of Paint 270 from Cup Interior 153 through First Aperture 310 and into Paint Tray Pocket 1391.

FIG. 38A again shows a perspective view of the additional embodiment of Cup 150, labeled in this FIG. 38A as Cup 150C, and shown in an extended position which creates additional volume in Cup Interior 153. In this additional embodiment Cup 150C is made of two separate parts, showing that Cup 150 is not limited in the number of components it can contain. Cup Top 154 has an inside diameter that matches the outside diameter of Cup Bottom 155 allowing for these two parts to slide along each other's longitudinal axes while maintaining a substantially airtight seal between them. By sliding these two parts away from each other this extension will allow for the intake of additional paint into Cup Interior 153 as described earlier, with less effort, and in less time. In this embodiment Cup 150C is made of two parts, but it could also be made of a greater quantity of parts to allow for more extension and more compression of Cup 150C.

FIG. 38B again shows a perspective view of the additional embodiment of Cup 150, labeled in this FIG. 38B as Cup 150C, and shown in a central position which shows the volume of Cup Interior 153 when not being compressed or extended by user. With volume of Cup Interior 153 being less than in additional embodiment shown in FIG. 38A, but with volume being greater than shown in additional embodiment in FIG. 38C. This would be a typical position for this embodiment when storing paint.

FIG. 38C again shows a perspective view of the additional embodiment of Cup 150, labeled in this FIG. 38C as Cup 150C, and shown in a more compressed position which creates less volume in Cup Interior 153. By sliding these two parts towards each other this compressed embodiment will allow for the expulsion of Paint 270 from Cup Interior 153, through First Aperture 310 and into Paint Tray Pocket 1391.

FIG. 39A again shows a perspective view of the additional embodiment of Cup 150, labeled in this FIG. 39A as Cup 150D, and shown in an extended position which creates additional volume in Cup Interior 153. In this embodiment Cup 150D is made of two separate parts, showing that Cup 150 is not limited in the number of components it can contain. Cup Top Female Threaded 156 has one cross section, (perpendicular to its longitudinal axis), the shape and size of which matches the shape and size of one cross section, (perpendicular to its longitudinal axis), of Cup Bottom Male Threaded 157, allowing for these two parts to move along each other's longitudinal axes while maintaining a substantially airtight seal between them. These two parts also have male and female threads that allow for these two parts to helically revolve about each other along their longitudinal axes thus increasing or decreasing the volume in Cup Interior 153, in this embodiment the volume of Cup Interior 153 is increased by rotating Cup Top Female Threaded 156 and Cup Bottom Male Threaded 157 away from each other, allowing for the intake of additional paint into Cup Interior 153 as described earlier, with less effort, and in less time. The use of male and female threads in this embodiment gives the user a finer control over the amounts, or control over the increments of Paint 270 transferred during use. It should be noted that Cup 150 could also be filled by inserting prefilled containers of paint into Cup 150, including but not limited to clear plastic bags with paint sealed within clear plastic bags that can be dropped into Cup 150 and by adding a vented piercing mechanism to the underside of Spout mechanism that would allow paint to flow from pre-filled container of paint through vented piercing mechanism at bottom of spout and into Paint Tray Pocket 1391 of Disposable Paint Tray 130.

FIG. 39B again shows a perspective view of the additional embodiment of Cup 150, labeled in this FIG. 39B as Cup 150D, and shown in a central position which shows the volume of Cup Interior 153 when not being fully extended or fully compressed. With volume of Cup Interior 153 being less than in additional embodiment shown in FIG. 39A, but with volume being greater than shown in additional embodiment in FIG. 39C. This would be a typical position for this embodiment when storing paint.

FIG. 39C again shows a perspective view of the additional embodiment of Cup 150, labeled in this FIG. 39C as Cup 150D, and shown in a more compressed position which creates less volume in Cup Interior 153. By rotating these two parts towards each other this compressed embodiment will allow for the expulsion of Paint 270 from Cup Interior 153, through First Aperture 310 and into Paint Tray Pocket 1391. As noted earlier with Cup 150C, Cup 150D can also be made of more than two parts to allow for greater extension and compression of Cup 150D.

FIG. 27, FIG. 28, FIG. 32 through FIG. 36A, and FIG. 40A—Alternative Embodiments FIG. 27 shows a perspective view of an alternative embodiment of a Paint Touch-up Kit Assembly with Carrying Tray 210 to conveniently hold all items, including additional disposable accessories, in an organized fashion with Rotatable Carrying Strap 220 rotated to the right, or left of vertical, (Rotatable Carrying Strap 220 is not limited to only rotating to make clearance for insertion of Cup 150, it could also be reattach-ably disconnected at one end or made of an alternate, more flexible material such as rope, or cloth), to allow for the insertion of Cup 150 of Touch-Up Paint Kit 100 into Carrying Tray 210. A plurality of Peel and Stick Label 240 are also shown that can be used to label Cup 150 with descriptive information by the user about the paint being held in Cup 150, including but not limited to, date stored, color name, room that was painted with this paint, where paint was purchased. Wet paint can be placed on label and when dry will show color of dry paint for ease of matching paint to painted area at some future time and when used at times by someone other than the user who prepared label, this is only one method to label embodiment, use of markers or paint on other various parts of embodiment are alternate methods of labeling.

FIG. 28 shows another perspective view of alternative embodiment shown in FIG. 27 but with Rotatable Carrying Strap 220 rotated to the vertical position to allow for carrying Touch-up Paint Kit 100 Assembly and Carrying Tray 210 while also securely holding down Top Cap 110 onto Trough Cap 140 with Strap Lock 230, which is moveably connected to Rotatable Carrying Strap 220 by Strap Lock Slot 231, during transit and storage. In this embodiment, by rotating the Rotatable Carrying Strap 220 to the vertical position over the top of Top Cap 110 and then sliding the moveable Strap Lock 230 along Rotatable Carrying Strap 220 until Strap Lock 230 is directly over Top Cap 110 so that Strap Lock 230 is now applying downward pressure on Top Cap 110 thus clamping Touch-Up Paint Kit 100 to keep Touch-Up Paint Kit 100 from being knocked over thus improving the substantially air tight sealing of Top Cap 110 onto Trough Cap 140 during transport, or storage as described earlier.

FIG. 32 shows a step for an alternative method of bringing paint into Cup Interior 153. Disposable Flexible Suction Tube 250 is removably attached to Touch-Up Paint Kit 100 at top open end of its Disposable Siphon Tube 170, this creates an unsealed Second Aperture 320 through Trough Cap Tube Vent 143, Disposable Siphon Tube Vent 172, and Disposable Flexible Suction Tube Vent 251 thereby exposing Cup Interior 153 to the external environment. Also shown is Paint Can 260 containing Paint 270. The distal end of Disposable Flexible Suction Tube 250 is shown not yet placed into Paint 270.

FIG. 32A shows a detail of FIG. 32 whereby Rotatable Pour Spout 120 is shown sealing off First Aperture 310 to Cup Interior 153 to allow entry or exit of external air or paint into Cup Interior 153 only through Second Aperture 320.

FIG. 33 shows another step for an alternative method of bringing paint into Cup Interior 153. Disposable Flexible Suction Tube 250 is again removably attached to Touch-Up Paint Kit 100 at top open end of its Disposable Siphon Tube 170. Also shown is Paint Can 260 containing Paint 270. The distal end of Disposable Flexible Suction Tube 250 is shown not yet placed into Paint 270. Also shown is Cup 150 in the squeezed position, user squeezes Cup 150 thus preparing to receive Paint 270 into Cup Interior 153, such that some air has been expelled from Cup Interior 153 through Second Aperture 320 created by Trough Cap Tube Vent 143, then through Disposable Siphon Tube Vent 172 and lastly through Disposable Flexible Suction Tube Vent 251 out into the external atmosphere or external environment, but prior to placing distal end of Disposable Flexible Suction Tube 250 into Paint 270.

FIG. 33A shows a detail of FIG. 33 whereby Rotatable Pour Spout 120 is shown sealing off First Aperture 310 to Cup Interior 153 to allow entry or exit of external air or paint into Cup Interior 153 only through Second Aperture 320.

FIG. 34 shows another step for an alternative method of bringing paint into Cup Interior 153. Disposable Flexible Suction Tube 250 is again removably attached to Touch-Up Paint Kit 100 at top open end of its Disposable Siphon Tube 170. Also shown is Paint Can 260 containing Paint 270. The distal end of Disposable Flexible Suction Tube 250 is shown placed into Paint 270 in preparation for bringing Paint 270 into Cup Interior 153. Also shown is Cup 150 in the squeezed position, (user squeezed Cup 150), such that some air has previously been expelled from Cup Interior 153 through Second Aperture 320 created by Trough Cap Tube Vent 143, then through Disposable Siphon Tube Vent 172 and lastly through distal end of Disposable Flexible Suction Tube Vent 251 out into the external atmosphere or external environment. Cup 150 remains squeezed in this step.

FIG. 34A shows a detail of FIG. 34 whereby Rotatable Pour Spout 120 is shown sealing off First Aperture 310 to Cup Interior 153 to allow entry or exit of external air or paint into Cup Interior 153 only through Second Aperture 320.

FIG. 35 shows another step for an alternative method of bringing paint into Cup Interior 153. Disposable Flexible Suction Tube 250 is again removably attached to Touch-Up Paint Kit 100 at top open end of its Disposable Siphon Tube 170. Also shown is Paint Can 260 containing Paint 270. The distal end of Disposable Flexible Suction Tube 250 is shown placed into Paint 270. Also shown is Cup 150 that has been un-squeezed by user and allowed to return to its normal shape thus enlarging Cup Interior 153 and creating a suction or vacuum which pulls Paint 270 through unsealed Second Aperture 320 via Disposable Flexible Suction Tube Vent 251, Disposable Siphon Tube Vent 172, and Trough Cap Tube Vent 143 and into Cup Interior 153. A plurality of Directional Arrow 280 shows the flow of Paint 270 from Paint Can 260 and into Cup Interior 153 through Disposable Flexible Suction Tube Vent 251 of Disposable Flexible Suction Tube 250 of unsealed or open Second Aperture 320. This flow of Paint 270 will continue until pressure inside of Cup Interior 153 matches pressure outside of Cup 150. Note that while level of Paint 270 in Cup Interior 153 is below the level of Paint 270 in Paint Can 260 a suction drawing paint from Paint Can 260 to Cup Interior 153 will be active, as is the case in this present embodiment.

FIG. 35A shows a detail of FIG. 35 whereby Rotatable Pour Spout 120 is shown sealing off First Aperture 310 to Cup Interior 153 to allow entry or exit of external air or paint into Cup Interior 153 only through Second Aperture 320.

FIG. 36 shows another step for an alternative method of bringing paint into Cup Interior 153. Disposable Flexible Suction Tube 250 is again removably attached to Touch-Up Paint Kit 100 at top open end of its Disposable Siphon Tube 170. Also shown is Paint Can 260 containing Paint 270. The distal end of Disposable Flexible Suction Tube 250 is shown still placed into Paint 270. In this FIG. 36 additional Paint 270 is being drawn into Cup Interior 153 as Rotatable Pour Spout 120 was rotated away from the sealed position, (see FIG. 36A), thus opening First Aperture 310 while second aperture is still liquidly connecting Paint 270 in Paint Can 260 with Paint 270 in Cup Interior 153. This additional flowing of paint will continue for as long as level of Paint 270 in Cup Interior 153 is lower than level of Paint 270 in Paint Can 260, which is the case in this FIG. 36. Cup Interior 153 is now filling with Paint 270 being siphoned out of Paint Can 260, and user can visually see through transparent Cup 150 and will know when to turn Rotatable Pour Spout 120 180-degrees, (although the rotation of Rotatable Pour Spout 120 has been consistently called out as being in 180-degree increments, that is not necessary as many other angles of turning could be used by simply reorienting the locations of various components and features of Touch-Up Paint Kit 100. 180-degree turns are only for the present embodiment and do not limit this turning feature in any way), to re-seal First Aperture 310 and stop flow of Paint 270 from Paint Can 260. The distal end of Disposable Flexible Suction Tube 250 can then be removed from Paint Can 260 and proximal end of Disposable Flexible Suction Tube 250 can now be removed from tip of Disposable Siphon Tube 170. Disposable Siphon Tube 170 can be removed from Trough Cap Tube 141 and Snap-On Seal Cap 133 can be snapped onto top of same Trough Cap Tube 141 and Touch-Up Paint Kit 100 is now sealed at both First Aperture 310 and Second Aperture 320 and is ready for storage or to be prepared to move Paint 270 from Cup Interior 153 and into Paint Tray Pocket 1391 as described earlier. In an alternative embodiment Floating Seal 330, (shown in FIG. 42A and FIG. 42B), can be installed in line of First Aperture 310 to stop Paint 270 from flowing, (flowing of Paint 270 as described in FIG. 32 through FIG. 36A previous, where a suction causes Paint 270 to flow continuously from Paint Can 260 to Cup Interior 153), into Cup Interior 153 when Cup Interior 153 becomes full. In this alternative embodiment with Floating Seal 330 the user would not need to be present to seal First Aperture 310 when Cup Interior 153 becomes full as First Aperture 310 would be sealed by Floating Seal 330 when Paint 270 rises to a level in Cup Interior 153 to cause the Floating Seal to seal First Aperture 310, and at the user's convenience the distal end of Disposable Flexible Suction Tube 250 can be removed from Paint Can 260 and proximal end of Disposable Flexible Suction Tube 250 can be removed from tip of Disposable Siphon Tube 170. Disposable Siphon Tube 170 can be removed from Trough Cap Tube 141 and Snap-On Seal Cap 133 can be snapped onto top of same Trough Cap Tube 141 and Second Aperture 320 is then sealed. First Aperture 310 can also be sealed at this time by rotating Rotatable Pour Spout 120 back over Spherical Sphere Boss 131 and Touch-Up Paint Kit 100 is now sealed at both First Aperture 310 and Second Aperture 320 and is ready for storage or to be prepared to move Paint 270 from Cup Interior 153 and into Paint Tray Pocket 1391 as described earlier.

FIG. 36A shows a detail of FIG. 36 whereby Rotatable Pour Spout 120 is shown not sealing off First Aperture 310 to Cup Interior 153 to allow for the exit of air through first aperture as Paint 270 is suctioned into Cup Interior 153 through second aperture, not shown in this detail.

FIG. 40A shows a cross section of FIG. 40 where we can see an alternative embodiment of Top Cap 110 with Moisture Distributor 290 located on underside of Top Cap 110. This Moisture Distributor 290 can be fixed in place with an interference fit between its outside shape and the inside shape of Top Cap 110, or by gluing, heat sealing or some other adhering method. Moisture Distributor 290 can be a synthetic or natural sponge or some other absorbent material. The purpose of Moisture Distributor 290 is to indefinitely extend the life of stored Paint 270. The user simply deposits some water onto Moisture Distributor 290 prior to snapping Top Cap 110 onto Trough Cap 140. The added moisture to the Interior of Touch-Up Paint Kit 100 will keep stored paint from drying indefinitely.

Advantages

Accordingly, several advantages of one or more aspects are as follows: these embodiments can use all standard types of painting applicators including but not limited to brushes, sponges, and rollers with the said paint roller's needed paint tray. These embodiments can do all sizes of paint touch-ups from small to large due to this ability to function with all painting applicator types. No need for a separate syringe to fill a paint storage area as a plurality of paint storage locations can be filled with the use of multiple removably attachable components that open and/or close at least two apertures that are an integral part of these embodiments. These embodiments show light weight and easy to use applicators as the user only needs to use applicators that almost all users will be familiar with: paint brushes, paint sponges and paint rollers with the necessary paint tray. These embodiments show multiple apertures which allow for the filling of a plurality of paint storage areas with no possibility of leaks and in at least one embodiment there is no need to invert the paint storage unit at all due to the use of multiple independently, and removably sealable apertures. No need to use a funnel or lift heavy paint cans or clumsy paint trays that are hard to balance when held. No need to put down drop cloths and no clean up as any parts that get contaminated are disposable, and replaceable. During usage the unit will not clog up due to paint build-up as those areas, as shown in these embodiments, are replaceable and/or made of non-stick, and/or highly polished materials so that paint will not adhere to them during use, also there are paint scraping features integral to these embodiments which also eliminate paint build up and post touch-up clean up. You can fill to any amount desired, no precise measuring needed. By placing the Touch-Up Paint Kit in the Carrying Tray shown in one embodiment, during use, the user cannot knock over the Touch-Up Paint Kit, further ensuring that no drop cloths are needed during touch-up painting. Because the disclosed subject matter shows an integral paint tray there is no worry of gravity pulling drops of paint from the various applicators as they can rest neatly in the paint tray when not applying paint. Although not limited to using only standard types of applicators: paint brushes, paint sponges and paint rollers, these applicators are known to be able to paint any areas that can be painted by conventional means, including overhead painting and painting hard to reach places. In one embodiment it is shown that the handles of the paint brush and paint roller can be removably attached to each other to further extend a user's reach for overhead and hard to reach places that need touch-up painting. Because the Touch-Up Paint kit can use standard types of applicators, there is no need to lift heavy applicators laden with the added weight of paint stored in the applicator. One embodiment also has a moisture distributor that humidifies the air where paint is stored, thus extending the use of the stored paint indefinitely.

Conclusion, Ramifications, and Scope

Accordingly, the reader will see that the Touch-Up Paint Kit of the various embodiments is a complete solution to doing touch-up painting under most conditions with no clean up needed after painting. Furthermore, the Touch-Up Paint Kit has the additional advantages in that:

- It permits for the use of all standard paint applicators, and many custom paint applicators as well.
- It allows the user to safely store larger quantities of paint in one storage area while conveniently working with a smaller amount of paint in another storage area.
- It allows for indefinite use due to the replaceability of components that get paint on them during use.
- It allows for no clean up after use by adding convenient items including but not limited to, scraper blades to remove paint from moving components, paint trays to catch dripping paint, paint catching pockets to also catch dripping paint, paint retaining walls to keep paint contained onto only disposable and replaceable components.
- It allows for easy transport and storage with a Carrying Tray that also serves to keep said Touch-up Paint Kit from being knocked over during use.
- It allows for having multiple quantities of disposable and replaceable components conveniently stowed in said Carrying Tray.
- It humidifies the air stored in said paint storage areas to extend life of stored paint indefinitely.
- It allows for greater use due to the elimination of using custom applicators that can be bulky, that need to be inverted to function, that require the user to do additional procedures during touch-up painting, including but not limited to, pushing on a piston to push paint out of said custom applicator for said touch-up painting, rotating a knob to push paint out of said custom applicator for said touch-up painting.

Although the description above contains many specificities, these should not be construed as limiting the scope of the embodiments but as merely providing illustrations of some of several embodiments. For example, openable and resealable apertures are described as functioning by either snapping on a removably attachable cap or by rotating a pour spout, but other methods for open-ably sealable apertures such as sliding covers, interference fit press-in plugs, removably screw-able caps would also work well; peel and stick labels for including information about the paint being stored are described but other methods such as writing directly onto paint cup or marking other areas of the Touch-Up Paint Kit with markers or by using the paint that is being stored, can also be used; the use of non-stick materials is described but highly polished surfaces are another method of keeping paint from sticking to said Touch-Up Paint Kit; cylindrically shaped paint storage areas are described but other shapes, including but not limited to ovals, squares, rectangles, etc. can also be used.

These are just a few examples and thus the scope of the embodiments should be determined by the appended claims and their legal equivalents, rather than by the examples given.

We claim:

1. A touch-up paint kit for use in an external environment comprising:

- at least two paint storage areas, one larger storage area within an interior of a cup which can be sealed off from the external environment with at least two apertures connecting said larger paint storage area to the external environment through a removably attached trough cap;
- wherein said at least two apertures are openable and closable;
- wherein said at least two apertures can be opened and closed together and separately;
- a flexible tube;
- a rigid tube;
- a rotatable pour spout;
- a first vent, said first vent traveling through the said flexible tube, said rigid tube and said rotatable pour spout creating a first aperture of said at least two apertures to deliver wet paint from said larger storage area to a smaller storage area that is an integral pocket in a disposable paint tray that mounts to the trough cap in close proximity to said larger paint storage area;

wherein said smaller storage area is used to hold smaller amounts of paint for touch-up painting;

wherein said smaller storage area is configured to accept paint brushes and paint rollers get paint for touch-up painting;

a second vent, said second vent disposed through the trough cap and acting as a second aperture of said at least two apertures for filling said larger storage area with paint via a siphon tube;

wherein said siphon tube is rigid and disposable;

thus extending open said second aperture to receive paint from an external paint source when said first aperture is sealed;

wherein closure of both said first aperture and said second aperture effectively seals any wet paint in the larger storage area from the external environment;

a top cap, said top cap acting as a third aperture that seals a third paint storage area from the external environment by removably snapping onto said trough cap holding another disposable paint tray above said trough cap, and also removably attaches to the cup below said trough cap;

wherein each said disposable tray edges and walls to remove excess paint from said brushes and rollers and catches any dripping paint; and wherein paint can be transferred from the external paint source to at least one of said paint storage areas of the touch-up paint kit.

2. The touch-up paint kit of claim 1, further comprising:

wherein paint can be transferred from said external paint source to at least one of said paint storage areas, and said cup configured to be compressed causing an expulsion of air within the cup and, upon release from compression, suction created pulls paint into the cup through the siphon tube without the use of any external tools preventing the possibility of paint spillage, eliminating clean up.

3. The touch-up paint kit of claim 1, further comprising:

a moisture distributor, said moisture distributor disposed in said top cap, said top cap configured to seal said third paint storage area and allow for indefinite storage of paint.

* * * * *